US007096957B2

(12) United States Patent
Nish et al.

(10) Patent No.: US 7,096,957 B2
(45) **Date of Patent: *Aug. 29, 2006**

(54) INTERNAL BEAM BUOYANCY SYSTEM FOR OFFSHORE PLATFORMS

(75) Inventors: Randall W. Nish, Provo, UT (US); Daniel C. Kennedy, II, Salt Lake City, UT (US); Randy A. Jones, Park City, UT (US)

(73) Assignee: Technip Offshore, Inc., Houston, TX (US)

( * ) Notice: Subject to any disclaimer, the term of this patent is extended or adjusted under 35 U.S.C. 154(b) by 331 days.

This patent is subject to a terminal disclaimer.

(21) Appl. No.: 10/669,159

(22) Filed: Sep. 23, 2003

(65) Prior Publication Data

US 2004/0126192 A1 Jul. 1, 2004

Related U.S. Application Data

(63) Continuation-in-part of application No. 10/349,476, filed on Jan. 21, 2003, now Pat. No. 6,805,201, which is a continuation-in-part of application No. 10/061,086, filed on Jan. 31, 2002, now abandoned.

(51) Int. Cl.
*E21B 29/12* (2006.01)

(52) U.S. Cl. ..... 166/367; 166/368; 405/224.3

(58) Field of Classification Search ..... 166/367, 166/368, 350; 405/223.1, 224, 224.1, 224.2, 405/224.3, 224.4; 114/264
See application file for complete search history.

(56) References Cited

U.S. PATENT DOCUMENTS

| | | | |
|---|---|---|---|
| 3,470,838 | A | 10/1969 | Daniell |
| 3,858,401 | A | 1/1975 | Watkins |
| 3,933,108 | A | 1/1976 | Baugh |
| 3,952,526 | A | 4/1976 | Watkins et al. |
| 3,957,112 | A | 5/1976 | Knibbe et al. |
| RE28,966 | E | 9/1976 | Blockwick |
| 3,992,889 | A | 11/1976 | Watkins et al. |
| 4,078,605 | A | 3/1978 | Jones |
| 4,099,560 | A | 7/1978 | Fischer et al. |
| 4,102,142 | A | 7/1978 | Lee |
| 4,176,986 | A | 12/1979 | Taft et al. |
| 4,249,610 | A | 2/1981 | Loland |
| 4,256,417 | A | 3/1981 | Bohannon |
| 4,390,186 | A | 6/1983 | McGee et al. |
| 4,398,487 | A | 8/1983 | Ortloff et al. |
| 4,422,801 | A | 12/1983 | Hale et al. |

(Continued)

FOREIGN PATENT DOCUMENTS

| | | | |
|---|---|---|---|
| GB | 2069450 | A | 8/1981 |

(Continued)

OTHER PUBLICATIONS

"Filament Wound Preforms for RTM"; SAMPE Journal, vol. 36, No. 2, Mar./Apr. 2000.

(Continued)

*Primary Examiner*—Thomas A Beach
(74) *Attorney, Agent, or Firm*—Klein, O'Neill &Singh LLP; Howard Klein

(57) ABSTRACT

A buoyancy system to buoy a riser of an offshore oil platform includes buoyancy compartments coupled around an elongated internal beam. The internal beam can withstand loads between the oil platform and the buoyancy system, while the buoyancy compartments provide buoyancy. The internal beam includes an elongated stem, a plurality of webs extending radially outwardly from the stem, and a plurality of transverse flanges attached to the outer edges of the webs.

53 Claims, 13 Drawing Sheets

U.S. PATENT DOCUMENTS 4,448,266 A 5/1984 Potts
4,470,722 A 9/1984 Gregory
4,474,129 A 10/1984 Watkins et al.
4,477,207 A 10/1984 Johnson
4,511,287 A 4/1985 Horton
4,596,531 A 6/1986 Schawann et al.
4,604,961 A 8/1986 Ortloff et al.
4,606,673 A 8/1986 Daniell
4,616,707 A 10/1986 Langner
4,630,970 A 12/1986 Gunderson et al.
4,634,314 A 1/1987 Pierce
4,646,840 A 3/1987 Bartholomew et al.
4,648,747 A 3/1987 Watkins et al.
4,652,022 A 3/1987 Nichols
4,702,321 A 10/1987 Horton
4,740,109 A 4/1988 Horton
4,768,455 A 9/1988 Maxson et al.
4,808,034 A 2/1989 Birch
4,821,804 A 4/1989 Pierce
4,934,871 A 6/1990 Kazokas, Jr.
5,044,828 A 9/1991 Berner, Jr. et al.
5,098,132 A 3/1992 Burton
5,330,294 A 7/1994 Guesnon
5,368,648 A 11/1994 Sekizuka
5,421,413 A 6/1995 Allen et al.
5,431,511 A 7/1995 Guy
5,439,060 A 8/1995 Huete et al.
5,439,321 A 8/1995 Hunter
5,447,392 A 9/1995 Marshall
5,542,783 A 8/1996 Pollack
5,558,467 A 9/1996 Horton
5,651,709 A 7/1997 Nandakumar et al.
5,706,897 A 1/1998 Horton, III
5,758,990 A 6/1998 Davies et al.
5,771,975 A 6/1998 Anderson et al.
5,823,131 A 10/1998 Boatman et al.
5,873,416 A 2/1999 Horton, III
5,881,815 A 3/1999 Horton, III
5,984,584 A 11/1999 McMillan et al.
6,000,422 A 12/1999 Shigemoto
6,004,074 A 12/1999 Shanks, II
6,067,922 A 5/2000 Denison et al.
6,092,483 A 7/2000 Allen et al.
6,155,748 A 12/2000 Allen et al.
6,161,620 A 12/2000 Cox et al.
6,164,348 A 12/2000 Rodwell et al.
6,179,524 B1 1/2001 Allen et al.
6,193,441 B1 2/2001 Fisher
6,213,045 B1 4/2001 Gaber
6,227,137 B1 5/2001 Allen et al.
6,347,912 B1 2/2002 Thomas
6,367,846 B1 4/2002 Aaron, III
6,375,391 B1 4/2002 Børseth et al.
6,406,223 B1 6/2002 Thomas
6,435,775 B1 8/2002 Nish et al.
6,439,810 B1 8/2002 Nish et al.
6,488,447 B1 12/2002 Nish et al.
6,805,201 B1 * 10/2004 Nish et al. ..... 166/367

FOREIGN PATENT DOCUMENTS

GB 2133446 A 7/1984
GB 2156407 A 10/1985

OTHER PUBLICATIONS

"Riser with composite choke/kill lines ready for Gulf of Mexico trails"; Offshore, Mar. 2000.

* cited by examiner

INTERNAL BEAM BUOYANCY SYSTEM FOR OFFSHORE PLATFORMS

This application is a continuation-in-part of U.S. patent application Ser. No. 10/349,476, filed Jan. 21, 2003 now U.S. Pat. No. 6,805,201, which is a continuation-in-part application of U.S. patent application Ser. No. 10/061,086, filed Jan. 31, 2002 now abandoned.

BACKGROUND OF THE INVENTION

1. Field of the Invention

The present invention relates generally to buoyancy systems for offshore oil platforms. More particularly, the present invention relates to a buoyancy system with an internal beam.

2. Related Art

As the cost of oil increases and/or the supply of readily accessible oil reserves are depleted, less productive or more distant oil reserves are targeted, and oil producers are pushed to greater extremes to extract oil from less productive oil reserves, or to reach more distant oil reserves. Such distant oil reserves may be located below the oceans, and oil producers have developed offshore drilling platforms in an effort to extend their reach to these oil reserves. In addition, some oil reserves are located farther offshore, and thousands of feet below the surface of the oceans.

For example, vast oil reservoirs have recently been discovered in very deep waters around the world, principally in the Gulf of Mexico, Brazil and West Africa. Water depths for these discoveries range from 1500 to nearly 10,000 ft. Conventional offshore oil production methods using a fixed truss type platform are not suitable for these water depths. These platforms become dynamically active (flexible) in these water depths. Stiffening them to avoid excessive and damaging dynamic responses to wave forces is prohibitively expensive.

Deep-water oil and gas production has thus turned to new technologies based on floating production systems. These systems come in several forms, but all of them rely on buoyancy for support and some form of a mooring system for lateral restraint against the environmental forces of wind, waves and current.

These floating production systems (FPS) sometimes are used for drilling as well as production. They are also sometimes used for storing oil for offloading to a tanker. This is most common in Brazil and West Africa, but not in Gulf of Mexico as of yet. In the Gulf of Mexico, oil and gas are exported through pipelines to shore.

Certain floating oil platforms, known as spars or Deep Draft Caisson Vessels (DDCV) have been developed to reach these oil reserves. Steel tubes or pipes, known as risers, are suspended from these floating platforms, and extend thousands of feet to reach the ocean floor, and the oil reserves beyond.

Typical risers are either vertical (or nearly vertical) pipes held up at the surface by tensioning devices (called Top Tensioned riser); or flexible pipes which are supported at the top and formed in a modified catenary shape to the sea bed; or steel pipe which is also supported at the top and configured in a catenary to the sea bed (Steel Catenary Risers—commonly known as SCRs).

The flexible and SCR type risers may in most cases be directly attached to the floating vessel. Their catenary shapes allow them to comply with the motions of the FPS caused by environmental forces. These motions can be as much as 10–20% of the water depth horizontally, and 10s of feet vertically, depending on the type of vessel, mooring and location.

Top Tensioned risers (TTRs) typically need to have higher tensions than the flexible risers, and the vertical motions of the vessel need to be isolated from the risers. TTRs have significant advantages for production over the other forms of risers, however, because they allow the wells to be drilled directly from the FPS, avoiding an expensive separate floating drilling rig. Also, wellhead control valves placed on board the FPS allow for the wells to be maintained from the FPS. Flexible and SCR type production risers require the wellhead control valves to be placed on the seabed where access is difficult and maintenance is expensive. These surface wellhead and subsurface wellhead systems are commonly referred to as "Dry tree" and "Wet Tree" types of production systems, respectively. Drilling risers must be of the TTR type to allow for drill pipe rotation within the riser. Export risers may be of either type.

TTR tensioning systems are a technical challenge, especially in very deep water where the required top tensions can be 1,000,000 lbs (1000 kips) or more. Some types of FPS vessels, e.g. ship shaped hulls, have extreme motions which are too large for TTRs. These types of vessels are only suitable for flexible risers. Other, low heave (vertical motion), FPS designs are suitable for TTRs. This includes Tension Leg Platforms (TLP), Semi-submersibles and Spars, all of which are in service today.

Of these, only the TLP and Spar platforms use TTR production risers. Semi-submersibles use TTRs for drilling risers, but these must be disconnected in extreme weather. Production risers need to be designed to remain connected to the seabed in extreme events, typically the 100-year return period storm. Only very stable vessels, such as TLPs and Spars are suitable for this.

Early TTR designs employed on semi-submersibles and TLPs used active hydraulic tensioners to support the risers by keeping the tension relatively constant during wave motions. As tensions and stroke requirements grow, these active tensioners become prohibitively expensive. They also require a large deck area, and the loads have to be carried by the FPS structure.

Spar type platforms recently used in the Gulf of Mexico use a passive means for tensioning the risers. These type platforms have a very deep draft with a central shaft, or centerwell, through which the risers pass. Types of spars include the Caisson Spar (cylindrical), the "Truss" spar and "Tube" spar. There may be as many as 40 production risers passing through a single centerwell.

It will be appreciated that these risers, formed of thousands of feet of steel pipe, have a substantial weight, which are supported by buoyant elements at the top of the risers. Steel buoyancy cans (i.e. air cans) have been developed which are coupled to the risers and disposed in the water to help buoy the risers, and eliminate the strain on the floating platform, or associated rigging. The steel buoyancy cans are typically cylindrical, and they are separated from each other by a rectangular grid structure referred to as riser "guides".

These guides are attached to the hull. As the hull moves, the tops of the risers are deflected horizontally with the guides. However, the risers are tied to the sea floor and have a fixed length; hence as the vessel moves horizontally the risers slide up and down (from the viewpoint of a person on the vessel the risers are moving vertically within the guides).

A wellhead at the sea floor connects the well casing (buried below the sea floor) to the riser with a special Tieback Connector. The riser, typically 9–14 inch diameter pipe, passes from the tieback connector through thousands of feet of seawater to the bottom of the spar and into the centerwell. Inside the centerwell the riser passes through a stem pipe, or conduit, which goes through the center of the buoyancy cans. This stem extends above the buoyancy cans themselves and supports the platform to which the riser and the surface wellhead are attached. The stem can be centered in the buoyancy cans by a "wagon wheel" type frame or spacer to hold or centralize the stem within the can. The riser can be centered in the stem by a "wagon wheel" type frame or spacer to hold or centralize the riser within the stem.

Since the surface wellhead ("dry tree") move up and down relative to the vessel, flexible jumper lines connect the wellhead to a manifold which carries the oil to a processing facility to separate water, oil and gas from the well stream.

The underlying principal of the buoyancy cans is to remove a load-bearing connection between the floating vessel and the risers. The buoyancy cans need to provide enough buoyancy to support the required top tension in the risers, the weight of the cans and stem, and the weight of the surface wellhead. One disadvantage with the air cans is that they are formed of metal, and thus add considerable weight themselves. Thus, the metal air cans must support the weight of the risers and themselves. In addition, the air cans are often built to pressure vessel specifications, and are thus costly and time consuming to manufacture.

In addition, as risers have become longer by going into deeper water, their weight has increased substantially. One solution to this problem has been to simply add additional air cans to the riser so that several air cans are attached in series. It will be appreciated that the diameter of the air cans is limited to the available width and length of the well bays within the platform structure. Thus, when additional buoyancy has been required, the natural solution has been to extend the length or number of the air cans. One disadvantage with more and/or larger air cans is that the additional length air cans adds more and more weight which also must be supported by the air cans, decreasing the air can s ability to support the risers. Another disadvantage of simply stringing more air cans together is that their weight and length make it very expensive, technically difficult and dangerous to install the buoyancy cans into the vessel's centerwell. Some of these steel air cans are up to 400 feet long and weigh 160,000 lbs. Another disadvantage with merely stringing a number air cans is that long strings of air cans may present structural problems themselves. For example, a number of air cans pushing upwards on one another, or on a stem pipe, may cause the cans or stem pipe to buckle.

In addition to providing buoyancy, the air cans also are subjected to loads or forces between the air can and the vessel. For example, the air cans are also subjected to side loads and bending loads caused by hydrodynamic loads acting on the air cans during vessel movement. Thus, air cans usually must be designed to address both buoyancy and dynamic loading.

SUMMARY OF THE INVENTION

It has been recognized that it would be advantageous to develop a buoyancy system for offshore oil platforms that decouples, or separately addresses, the simultaneous design challenges of 1) resolving loads and forces imposed on the buoyancy system, and 2) providing the required buoyancy to properly tension the riser system.

The invention provides a buoyancy system with an internal beam device to buoy one or more risers of an offshore oil platform. The risers can be operatively coupled to the oil platform and can extend from the oil platform to a seabed, and can conduct oil or gas therethrough. The buoyancy system can be movably disposed in the oil platform, and can apply a buoyancy force to the risers needed to support the risers.

The buoyancy system advantageously can include an elongated internal beam configured to withstand side and bending loads transferred between the oil platform and the buoyancy system. In one aspect, the internal beam can extend substantially along the length of the buoyancy system. The internal beam includes an elongated stem with an axially disposed bore to receive the risers therethrough. In addition, the internal beam includes a plurality of webs extending substantially along a length of the elongated stem. The webs have inner edges attached to the stem, and extending radially outward therefrom to opposite outer edges. Furthermore, the internal beam includes a plurality of transverse flanges attached to the outer edges of the webs. Together, the stem, the webs, and the transverse flanges form a structural beam to withstand loads between the buoyancy system and the oil platform.

In addition, the buoyancy system can include one or more enclosures or compartments coupled to the stem. The enclosures contain a buoyant material to produce a buoyancy force when submerged.

In accordance with a more detailed aspect of the present invention, the buoyancy system can include a rib and groove interface between the compartments and the internal beam. A plurality of ribs can be formed along the stem, while a plurality of mating grooves can be formed in the compartments. The ribs and the grooves can intermesh so that the buoyancy force of the compartment is transferred to the stem through the ribs.

In accordance with another more detailed aspect of the present invention, each of the plurality of compartments can include a one-piece, continuous liner encapsulated in a fiber composite matrix laminate. The liner can be formed by rotational molding.

Additional features and advantages of the invention will be apparent from the detailed description which follows, taken in conjunction with the accompanying drawings, which together illustrate, by way of example, features of the invention.

DETAILED DESCRIPTION

Figure 1:
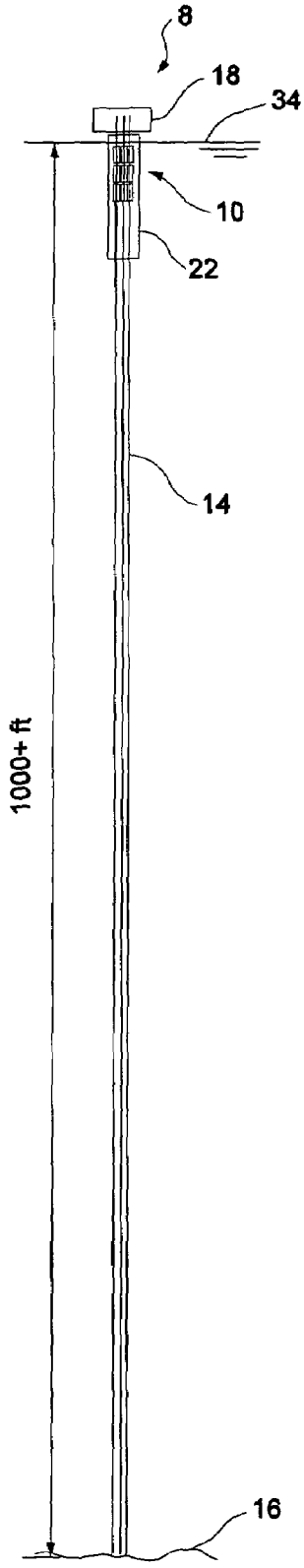
FIGS. 1 and 2 are schematic side views a floating oil platform utilizing a buoyancy system in accordance with an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
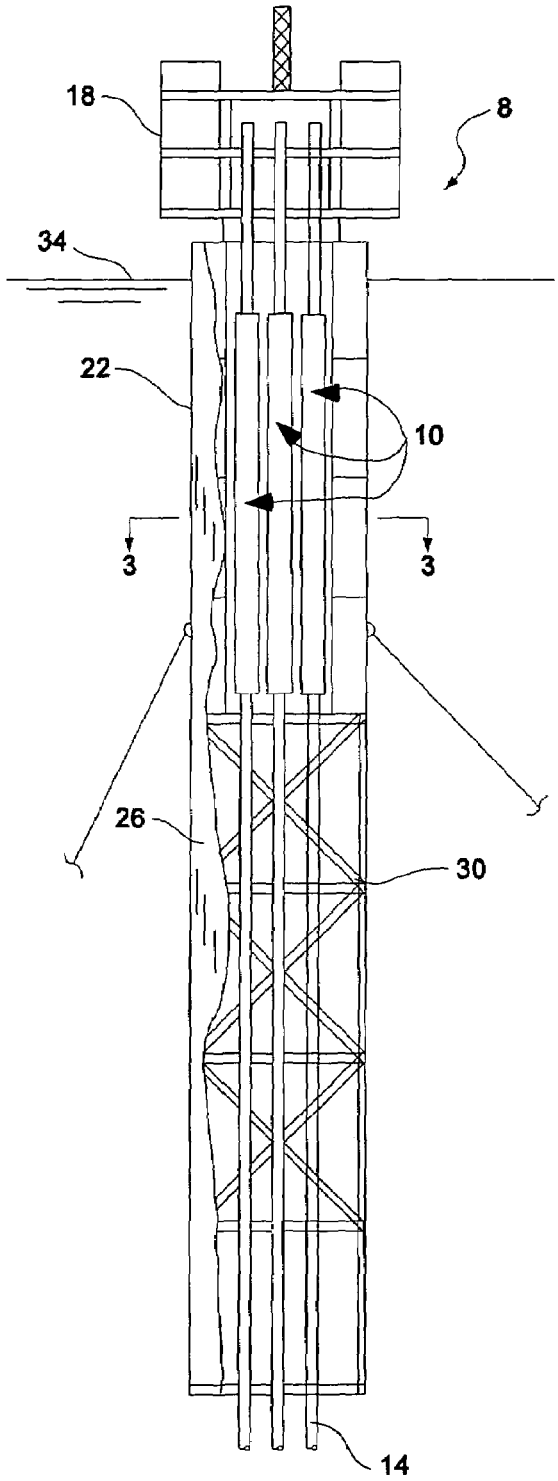
Figure 3:
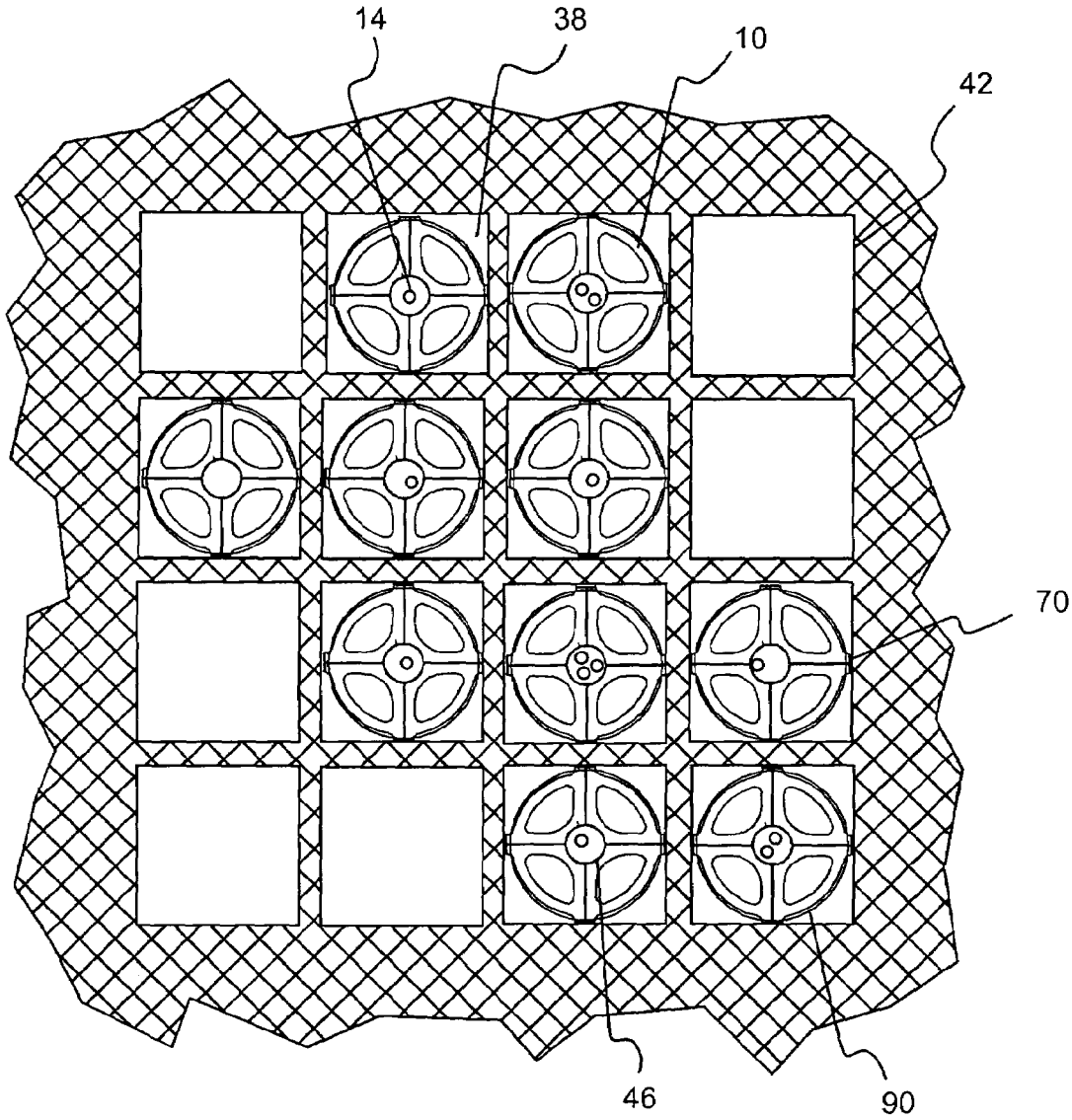
FIG. 3 is a schematic, partial cross-sectional top view of the oil platform with the buoyancy system of FIG. 1, taken along line 3—3 of FIG. 2.

As illustrated in FIGS. 1–3, an offshore oil platform 8 or system is shown with a buoyancy system 10 including an internal beam 12 (FIG. 4) in accordance with the present invention. The buoyancy system 10 provides buoyancy to, and top tensions, one or more risers 14, or a riser system, that is operatively coupled to, and extends from, the platform 8 to the seabed or ocean floor 16. Thus, each riser or riser system can have a buoyancy system 10. As described below, the buoyancy system 10 advantageously decouples, or separately addresses, the simultaneous design challenges of 1) resolving loads and forces imposed on the buoyancy system 10, and 2) providing the required buoyancy to properly buoy and top-tension the risers 14. Separately addressing the imposed loading and the buoyancy requirements advantageously allows the buoyancy of the buoyancy system to be increased so that the length and/or diameter of the risers can be increased to reach more distant oil reserves.

The platform 8 can be a deep-water, floating oil platform, as shown. Deep water oil drilling and production is one example of a field that may benefit from use of such a buoyancy system 10. Such buoyant platforms can be located above and below the surface, and can be utilized in drilling and/or production of fuels, such as oil and gas, typically located offshore in the ocean at locations corresponding to depths of over several hundred or thousand feet. In addition, such buoyant platforms can include classical, truss, tube and concrete spar-type platforms or Deep Draft Caisson Vessels, etc. Thus, the oil or gas reserves are located below the ocean floor at depths of over several hundred or thousand feet of water.

In addition, the platform 8 can be a truss-type, floating platform, as shown, and can have above-water, or topside, structure 18, and below-water, or submerged, structure 22. The above-water structure 18 can include several decks or levels which support operations such as drilling, production, etc., and thus may include associated equipment, such as a work over or drilling rig, production equipment, personnel support, etc. The submerged structure 22 can include a hull 26, which may be a full cylinder form. The hull 26 may include bulkheads, decks or levels, fixed and variable seawater ballasts, tanks, etc. The hull 26 can include hard tanks for providing buoyancy to the hull, as is known in the art. The fuel, oil or gas may be stored in tanks in the hull. The platform 8, or hull 26, also has mooring fairleads to which mooring lines, such as chains or wires, are coupled to secure the platform or hull to an anchor in the sea floor.

The hull 26 or submerged structure 22 also can include a truss or structure 30. The hull 26 and/or truss 30 may extend several hundred feet below a surface 34 of the water, such as 650 feet deep. A centerwell or moonpool 38 (FIG. 3) can be located in the hull 26 or truss structure 30. The buoyancy system 10 can be movably located in the hull 26, truss 30, and/or centerwell 38 and movable with respect to one another. The centerwell 38 is typically flooded and contains compartments 42 (FIG. 3) or sections for separating the risers and the buoyancy system 10. Each compartment can contain a buoyancy system 10, and one or more risers. The hull 26 provides buoyancy for the platform 8, while the centerwell 38 protects the risers and buoyancy system 10.

It is of course understood that the truss-type, floating platform 8 depicted in FIGS. 1 and 2 is merely exemplary of the types of floating platforms that may be utilized. For example, other spar-type platforms may be used, such as classic spars, tube or concrete spars. In addition, it is understood that the platform can float partially or wholly submerged.

The buoyancy system 10 supports the deep water risers 14 which extend from the floating platform 8, near the water surface 34, to the bottom of the body of water, or ocean floor 16. The risers 14 are typically steel pipes or tubes with a hollow interior for conveying the fuel, oil or gas from the reserve, to the floating platform 8. Such pipes or tubes can extend over several hundred or thousand feet between the reserve and the floating platform 8, and can include production risers, drilling risers, and export/import risers. The deep-water risers 14 can be coupled to the platform 8 by a thrust plate located on the platform 8 such that the risers 14 are suspended from the thrust plate, as is known in the art. In addition, the buoyancy system 10 can be coupled to the thrust plate such that the buoyancy system 10 supports the thrust plate, and thus the risers 14. An example of such attachments of the risers to the platform can be found in U.S. patent application Ser. No. 09/997,411, which is herein incorporated by reference.

The buoyancy system 10 can be utilized to access deep-water oil and gas reserves with deep-water risers 14 which extend to extreme depths, such as over 1000 feet, over 3000 feet, and even over 5000 feet. It will be appreciated that thousand feet lengths of steel pipe are exceptionally heavy, or have substantial weight. It also will be appreciated that steel pipe is thick or dense (i.e. approximately 0.283 lbs/in$^3$), and thus experiences relatively little change in weight when submerged in water, or seawater (i.e. approximately 0.037 lbs/in$^3$). Thus, for example, steel only experiences approximately a 13% decrease in weight when submerged. Therefore, thousands of feet of riser, or steel pipe, is essentially as heavy, even when submerged.

The buoyancy system 10 can be submerged and can include a buoyant material, such as air, to produce a buoyancy force to buoy, support or tension the risers 14. The buoyancy system 10 can be coupled to one or more risers 14 via the thrust plate, or the like. Therefore, the risers 14 exert a downward force due to their weight on the thrust plate, while the buoyancy system exerts an upward force on the thrust plate, as mentioned above and as known in the art. The upward force exerted by the buoyancy system 10 can be equal to or greater than the downward force due to the weight of the risers 14, so that the risers 14 do not pull on the platform 8 or rigging.

As stated above, the thousands of feet of risers 14 exert a substantial downward force on the buoyancy system 10. It will be appreciated that the deeper the targeted reserve, or as drilling and/or production moves from hundreds of feet to several thousands of feet, the risers 14 become exceedingly more heavy, and more and more buoyancy force will be required to support the risers 14. It has been recognized that it would be advantageous to optimize the systems and processes for accessing deep reserves, to reduce the weight of the risers and platforms, and increase the buoyant force. In addition, it will be appreciated that the risers 14 move with respect to the platform 8 and centerwell 38, and that such movement between the buoyancy system and centerwell 38 or platform 8 can exert lateral forces and/or bending forces on the buoyancy system. It will also be appreciated that as the vessel pitches and rolls about the keel that it drags the risers and buoyancy cans through the water trapped within the centerwell, thereby imposing hydrodynamic loads on the buoyancy cans. Thus, it has been recognized that it would be advantageous to increase the structural integrity of the buoyancy system, while at the same time reducing weight and increasing buoyancy. In addition, it has been recognized that it would be advantageous to decouple, or separately address, the simultaneous design challenges of 1) resolving loads and forces imposed on the buoyancy system 10, and 2) providing the required buoyancy to properly buoy and top-tension the riser system 14.

As stated above, the buoyancy system 10 advantageously includes an elongated internal beam 12 (FIG. 4) to withstand loads between the oil platform 8 or centerwell 38 and the buoyancy system 10. The internal beam 12 can extend substantially along the buoyancy system 10, or along a substantial length of the buoyancy system 10, to withstand loads imposed along the length of the buoyancy system. The thickness of each member of this beam assembly can be sized differently depending on the side or bending loads experienced in that particular location. Referring to FIGS. 4–8, the buoyancy system 10 or internal beam 12 can include an elongated stem 46 with an axially disposed bore 50 to receive the risers 14 therethrough. Thus, the stem 46 can be tubular.

Figure 8:
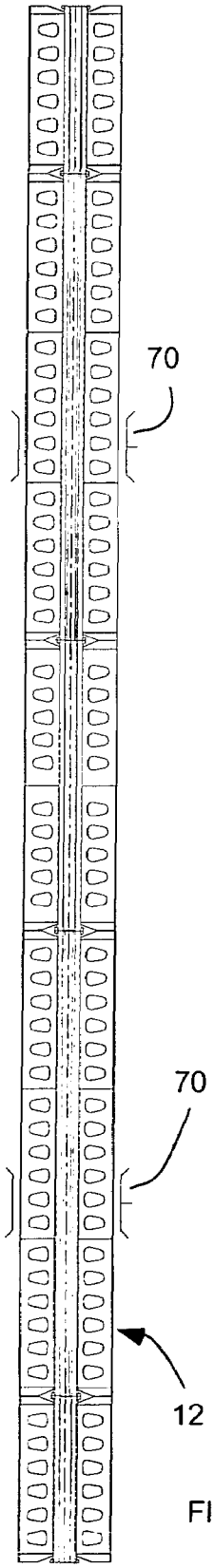
FIG. 8 is a side view of an internal beam of the buoyancy system in accordance with the present invention.

A plurality of webs 54 extend substantially along a length of the elongated stem 46. The webs 54 have inner edges 58 attached to the stem 46, and extend outward radially therefrom to opposite outer edges 62. A plurality of transverse flanges 66 can be attached to the outer edges 62 of the webs 54. Together, the stem 46, the webs 54 and the flanges 66 form a structural beam to withstand loads between the buoyancy system 10 and the oil platform 8. As the buoyancy system 10 and the internal beam 12 move in the platform 8 or the centerwell 38, and as the risers 14 and the platform 8 pull on one another, forces, loads and/or torques are applied between the platform 8 and the buoyancy system 10. The forces, loads and/or torques between the platform 8 and the buoyancy system 10 or the risers 14 can act on the internal beam 12. The beam configuration allows the buoyancy system to withstand the imposed forces. The flanges 66 also can bear against or contact the platform 8, centerwell 38, or other structure associated with the centerwell 38, such as bearing surfaces, glide plates, or rollers, indicated at 70 (FIG. 8).

Figure 6:
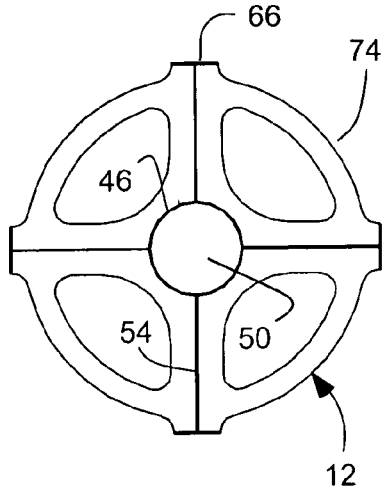
FIG. 6 is an end view of the internal beam of FIG. 4.
Figure 7:
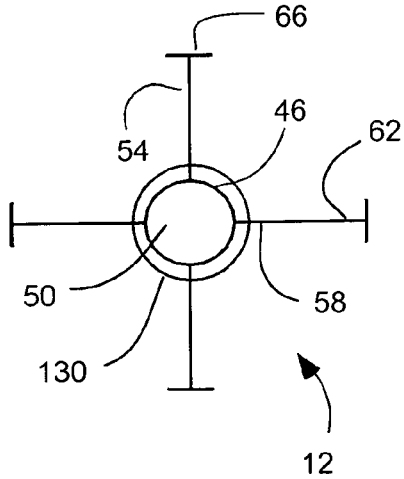
FIG. 7 is a cross sectional end view of the internal beam of FIG. 4.

Referring to FIGS. 6 and 7, in one aspect, the plurality of webs 54 can include four webs oriented in two different orientations. For example, the two different orientations can be perpendicular, so that the four webs are located 90 degrees apart to form a cross-section with an "X"-shape or "+"-shape. Thus, the webs 54 can be disposed in pairs, with each web of the pair being disposed on opposite sides of the stem 46. A second pair of webs can be oriented perpendicularly to a first pair of webs. The internal beam 12 may be conceptualized as a pair of intersecting I-beams, with a tube or stem at the intersection to accommodate the risers. The intersecting or perpendicular configuration allows the internal beam to withstand forces imposed from multiple directions. The internal beam 12 has external structure, such as flanges 66, disposed at a perimeter of the buoyancy system 10 to contact and be acted upon by the platform 8, and internal structure, such as the webs 54 and stem 46, to accommodate the imposed loads. The flanges 66 also act as a foundation for wear resistant strips that rub directly against the buoyancy system guides 70. In addition, the cross-sectional shape of the internal beam 12 allows the beam or webs to extend across the compartments 42 of the centerwell 38 (FIG. 3) in multiple directions. The flanges 66 can bear against buoyancy system guides 70 located in the corners of each compartment 42 or centerwell 38 as the buoyancy system 10 moves in the centerwell, and as forces or loads are transferred between the buoyancy system 10 and platform 8.

Referring again to FIGS. 4–7, the buoyancy system 10 or internal beam 12 can include two or more bulkheads 74. The bulkheads 74 can be disposed around the stem 46 and oriented transverse to both the stem 46 and the plurality of webs 54. Portions of the bulkheads 74 can extend between adjacent webs. Thus, the bulkheads 74 can be provided in quadrants or quarters with each quadrant or quarter extending between the webs. The bulkheads 74 can support the webs 46 with respect to the stems 46, and the flanges 66 with respect to the webs 54. A plurality of bulkheads 74 can be disposed along the length of the stem 46 or buoyancy system 10. An array of apertures 78 can be formed in the webs 54, and can extend along the length of the webs. The apertures 78 remove material from the webs, thus reducing their weight. The interior of the stem can have a polymer liner, such as a coal tar epoxy, or a dissimilar metallic coating such as thermal sprayed aluminum to inhibit corrosion and oxidation. The outer surfaces of the stem, webs, or flanges can be coated with a dissimilar metallic coating, such as a thermal sprayed aluminum.

Figure 5:
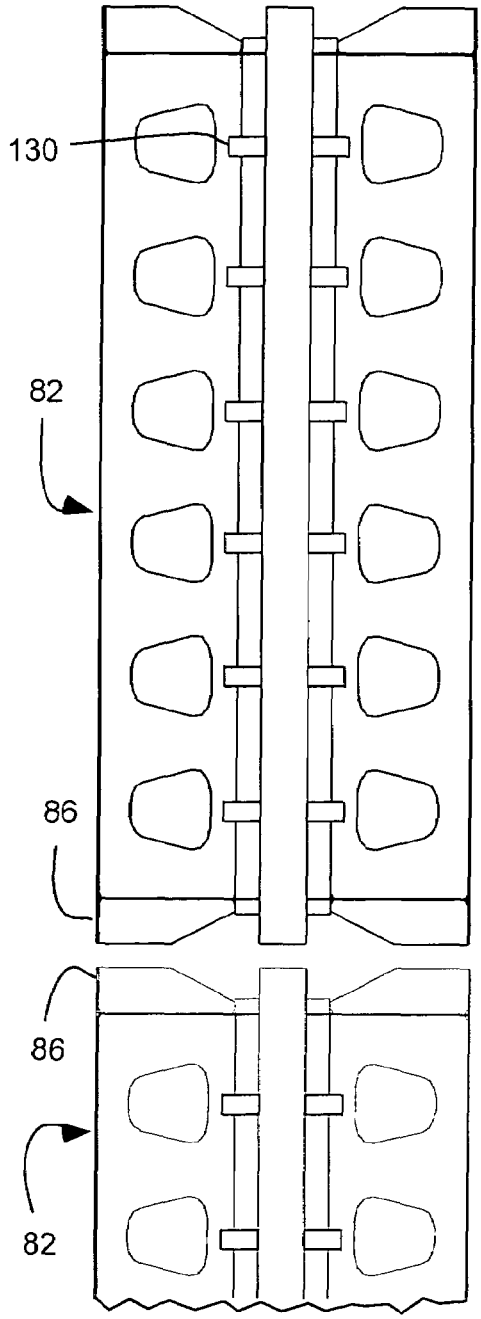
FIG. 5 is a partial side view of two modular internal beams of the buoyancy system in accordance with an embodiment of the present invention.
Figure 5B:
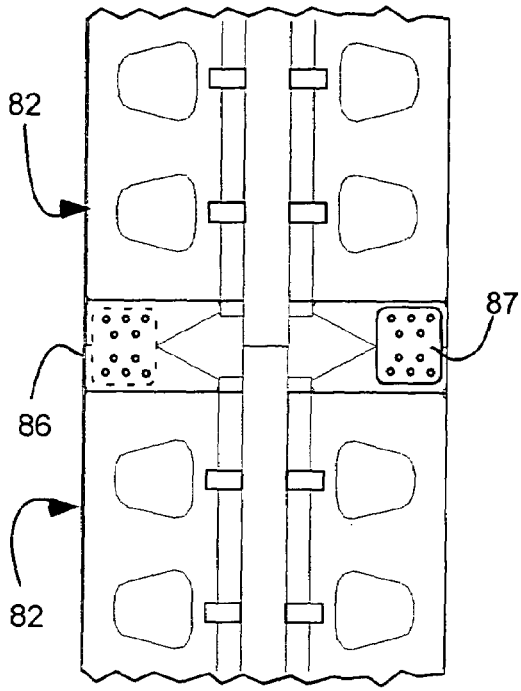
FIG. 5*b* is a partial side view of a connection between two modular internal beams of the buoyancy system in accordance with an embodiment of the present invention.
Figure 5C:
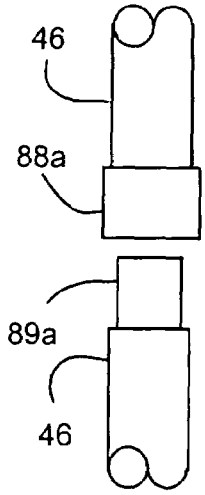
FIGS. 5*c* and 5*d* are partial side views of a connection between two stems of the buoyancy system in accordance with an embodiment of the present invention.
Figure 5D:
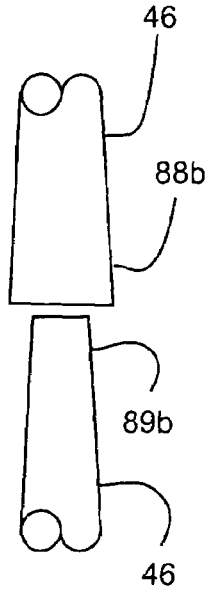

The buoyancy system 10 can be modular, with a plurality of discrete sections or modules that can be coupled together to form the length of the buoyancy system. The sections or modules can be easier to transport, handle and assemble in the platform. Thus, the stem 46, the webs 54 and the transverse flanges 66 can be provided in a plurality of modular sections 82 (FIG. 5). The modular sections 82 can be joined end-to-end in series to form the length of the buoyancy system 10. Each modular section 82 or buoyancy module can include at least two bulkheads 74 with one at a top of the section and the other at a bottom of the section. Fins 86 can extend from the modular sections 82 (FIG. 5) or bulkheads, and can be used to couple adjacent modular sections so that the sections 82 can be connected together to form a continuous beam. For example, referring to FIG. 5*b*, a plurality of fins 86 can extend from each modular section towards the fins of an adjacent modular section. The fins 86 can be coupled together with a plurality of splice plates 87. Each splice plate 87 can be coupled to a pair of adjacent fins 86. Thus, the ends of the modular sections 82 can abut to one another, with the splice plates 87 overlapping the fins 86 to couple adjacent modular sections. The splice plates 87 can be secured to the fins 86 by welding. Alternatively, bolts can extend through bores in the fins 86 and the splice plates 87. Thus, a plurality of modular sections 82 can be coupled together to form the length of the buoyancy system 10, or the elongated internal beam 12, as shown in FIG. 8. The size and weight of the modular sections 82 can be limited to lengths and weights easily handled by standard equipment or deck cranes on the platform, for example less than 60 feet and less than 70,000 lbs, while the internal beam 12 formed by the modular sections 82 can extend much longer, for example 120–300 feet or longer. It is believed that modular sections 82 with a length between approximately 20–22 feet, and a width or diameter of approximately 12 feet, are best. In addition, referring to FIG. 5*c*, the stems 46 of adjacent modular sections 82 can overlap, with the end of one stem being received within the end of another stem. For example, the lower end of one stem can be enlarged or have a larger inner diameter, indicated at 88*a*, to receive the upper end of the other stem. Alternatively, the upper end of one stem can be reduced or have a smaller outer diameter, indicated at 89*a*, to be received in the lower end of the other stem. The ends of the stems can be press-fit together, or can have an interference fit. In addition, the ends of the stems can be welded together. The ends 88*b* and 89*b* can be tapered as shown in FIG. 5*d*.

As stated above, the internal beam can have a width or diameter of approximately 12 feet. Thus, the width or diameter of the buoyancy system can be greater than that of prior art systems, which are typically 8 feet. The diameter of prior art air cans was largely dictated by the depth of the oil reserve, weight of the risers, and the maximum feasible/safe length of the air cans; and limited by available fabrication techniques. Increasing the diameter of prior art air cans over eight feet would have required costly construction techniques. For example, it would have been difficult and costly to roll larger steel skin pieces for the air cans. The diameter of the present internal beam can be much greater than prior art air cans, without increasing manufacturing costs, and without requiring special manufacturing techniques. Thus, the buoyancy system of the present invention can have greater buoyancy per unit length, and can be less expensive per unit length (or less expensive per pound of buoyancy provided). In addition, the buoyancy system of the present invention can be shorter than an equivalent prior art air can. Furthermore, it will be appreciated that the width or diameter of the entire platform is driven by the diameter and number of the air cans.

The internal beam 12 can be formed of metal. For example, the stem 46 can be a metal tube, while the webs 54 can be metal plates welded to the stem 46. Similarly, the flanges 66 can be metal plates welded to the webs 54. The bulkheads 74 also can be metal welded to the webs. With the modular design of the internal beam 12, there are only a few pieces to make, and they can be made much easier and faster than with the prior designs. The stem 46 can simply be thick wall steel pipe that can be cut and welded back together to form the desired length. The webs 54 can simply be large flat rectangles (such as approximately 20 by 4.5 feet). Such webs can be cut robotically and stacked flat, with or without the apertures 78. Similarly, the bulkheads 74 can be roughly quarter circle flat plates that can also be cut robotically and stacked flat, with or without apertures. The fins 86 can be separately cut robotically stacked. The cut portions can then be fixtured and welded without complexity, by automated welding equipment in more modern shops. It will be appreciated that the above described configuration provides significant economic advantages. The webs 54, bulkheads 74 and/or fins 86 can be precut in batch. In addition, the stem 46, webs, 54, bulkheads 74 and/or fins 86 can be assembled along long and straight weld lines that can be welded by automated welding systems.

Referring to FIGS. 9–15, the buoyancy system 10 can include one or more buoyant enclosures or compartments 90 coupled to the internal beam 12, or to the stem 46. The buoyant compartments 90 can contain a buoyant material 94, such as air. It is of course understood that the buoyant material can include other buoyant materials, such as foam. The buoyant material and buoyant compartments produce a buoyancy force when submerged. The buoyancy force produced by the buoyant compartments is transferred to the stem.

The buoyancy system 10, or each section 82 thereof, can include four buoyancy compartments 90 circumscribing the stem 46 and disposed in the spaces between the webs 54. The compartments 90 can be sized and shaped to extend between the adjacent webs 54, and between the bulkheads 74. Thus, the compartments 90 can substantially fill the buoyancy system 10 (or sections 82), or spaces between the webs, to maximize the buoyancy force. The buoyant compartments 90 can include opposite side walls 100 and 102 disposable adjacent the webs 54, an inner wall 106 disposable adjacent the stem 46, and an outer wall 110 opposite the inner wall 106. The side walls 100 and 102 can be oriented perpendicular to one another to match the perpendicular orientation of the webs 54. The inner wall 106 can be arcuate to match a circular shape of the stem 46. Similarly, the outer wall 110 can be arcuate to resist contact with the centerwell 38 or compartments 42, and to provide stiffness to the outer wall. In addition, the compartments 90 can include upper and lower, or top and bottom, walls 114 and 116 that can extend to the upper and lower bulkheads of each section. Ribs can be integrally formed in the top wall 114 to provide rigidity and structural integrity. Together, the walls form the enclosure or compartment.

Figure 16:
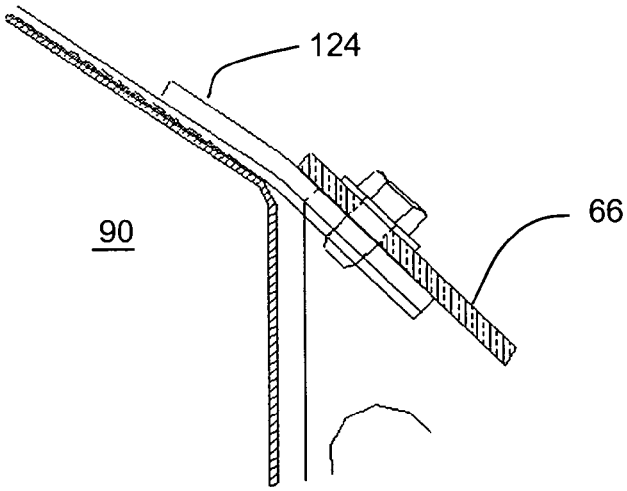
FIG. 16 is a detail view of an attachment of a strap to retain the buoyancy compartment to the internal beam of the buoyancy system in accordance with an embodiment of the present invention.

A plurality of straps can be used to retain the enclosures or compartments on the internal beam. A plurality of arcuate indentations 120 can be formed in the outer wall 110 of the enclosures 90. A plurality of retention straps 124 (FIG. 16) can be attached to the internal beam 12 and can engage the indentations 120 to secure the compartments 90 to the internal beam. The indentations 120 retain the straps 124 with respect the compartments 90, and resist slipping between the two. The straps 124 and indentations 120 are one example of a means for securing the compartments to the internal beam. The straps 124 can be secured to the flanges 66, such as with bolts or plug welded joints, as shown in FIG. 16. Thus, the straps 124 can extend between adjacent flanges to hold the compartments 90 against the stem 46.

Figure 4:
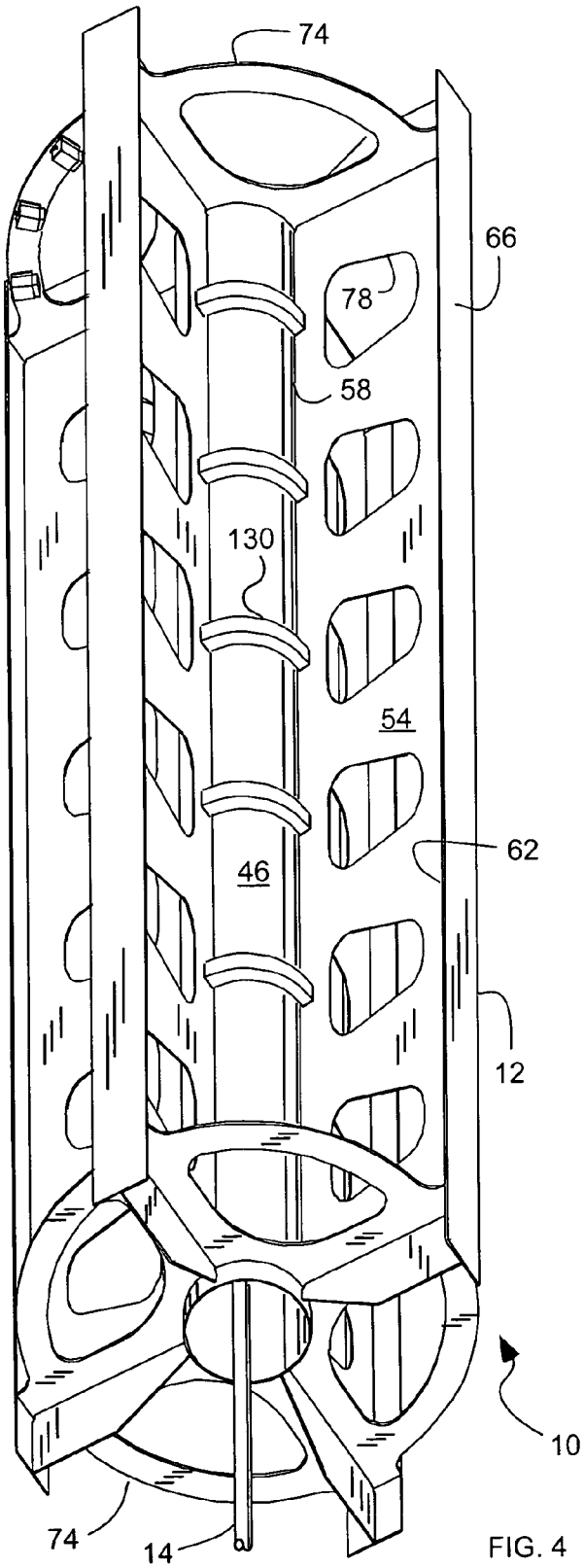
FIG. 4 is a partial perspective view of an internal beam of the buoyancy system in accordance with an embodiment of the present invention.
Figure 20:
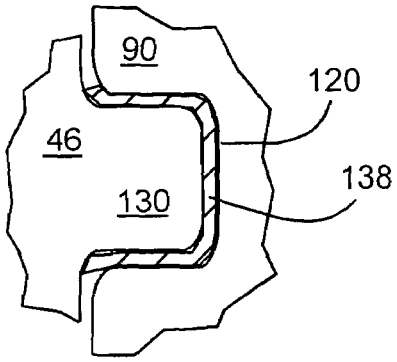
FIG. 20 is a detail view of a mating rib and groove connection between the buoyancy compartment and internal beam in accordance with an embodiment of the present invention.

In addition, a mating rib and groove system can be used to longitudinally secure the enclosures or compartments to the stem, and to transmit buoyant force from the compartments directly to the stem. A plurality of ribs 130 can be formed along the stem 46, as shown in FIGS. 4 and 5. A plurality of mating grooves 134 can be formed in the compartments 90. The ribs 130 and the grooves 134 can intermesh so that the buoyancy force of the compartments 90 is transferred to the stem 46 through the ribs 130. For example, the ribs and grooves can be formed approximately every three feet. Referring to FIG. 20, it will be appreciated that gaps may be formed between the ribs and the grooves that reduce the efficiency of the force transfer, and/or create stress concentrations. Shims 138 can be disposed in the gaps between the ribs and the grooves to reduce stress concentrations. For example, the shims can be liquid shims, formed of thermoset composite, RTV rubber or microballon cement.

Referring again to FIGS. 11–15 and 19*a*, each of the compartments 90 can be formed as a one-piece, continuous liner 144. Thus, the walls of the compartment can be formed as a single, integral piece. In one aspect, the compartments 90 or liner can be formed of a thermoplastic material. Thus, the compartments 90 can be lighter-weight than traditional steel air cans. The compartment 90 or liner can be formed in a rotomold process to form the one-piece, continuous liner. In addition, the compartment or liner can be encapsulated in a fiber composite matrix laminate 148. The fiber composite can form an outer layer that acts to limit radial deflection of the inner and outer walls 106 and 110, limit axial deflection in the top wall 114, and can act as thermal protection against welding spatter, hot grinding particles, etc.

Furthermore, the thermoplastic material and/or fiber composite matrix laminate can include a pigment to color the material to facilitate inspection. For example, the pigment can be a yellow, light blue, orange, mauve, etc. Such colors allow for inspection by ROV video cameras. In addition, an outer layer of the compartments 90 can be provided with a traction layer to allow for traction while walking on the compartments. It will be appreciated that the material forming the compartments can be slick or slippery. To prevent slipping when walking on the compartments, the traction layer can be integrally molded.

As described above, the compartments 90 can be filled with a buoyant material, such as pressurized air, to be buoyant. The side walls 100 and 102 of the compartments 90 can be flexible, or can be formed of a flexible material. Thus, as the compartments 90 are pressurized the side walls press or bear against the webs 54 and apply a lateral load to the webs. The pressure against the webs 54 can help stabilize and support the webs.

The buoyancy compartments 90 are one example of a buoyancy means for containing a buoyant material and securing the buoyant material to the stem. It is of course understood that other buoyancy means are possible, including compartments of different shapes, numbers, materials, etc.

Figure 9:
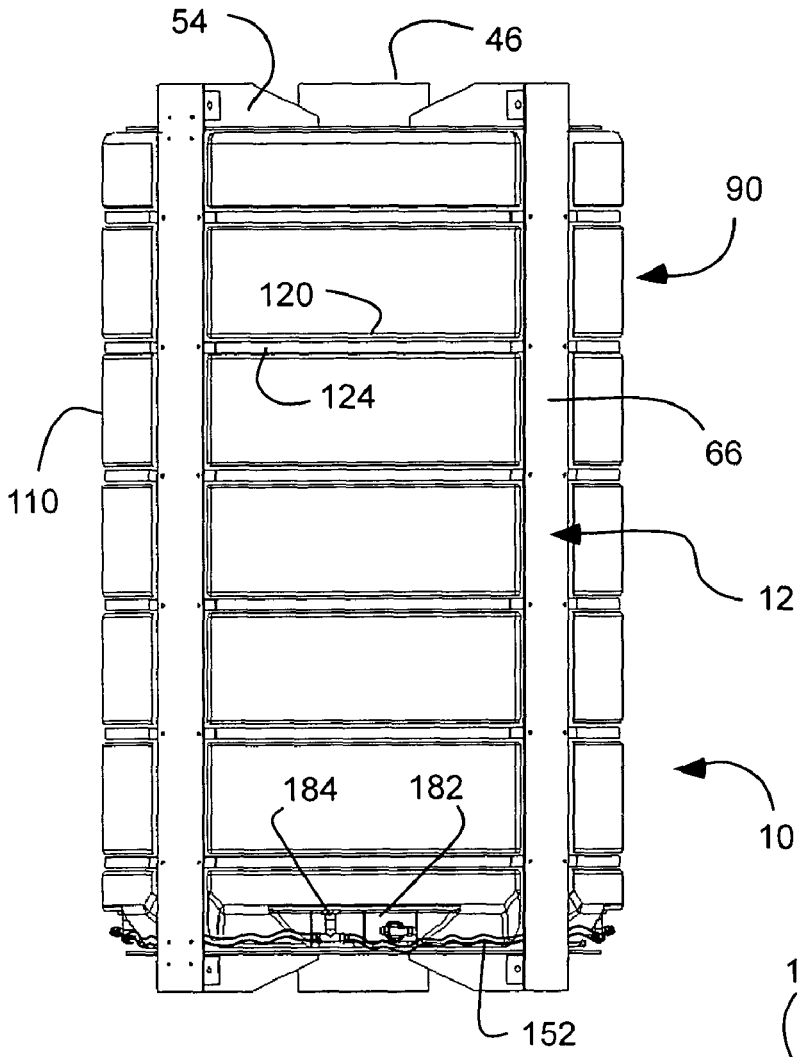
FIG. 9 is a partial side view of the buoyancy system in accordance with the present invention.
Figure 10:
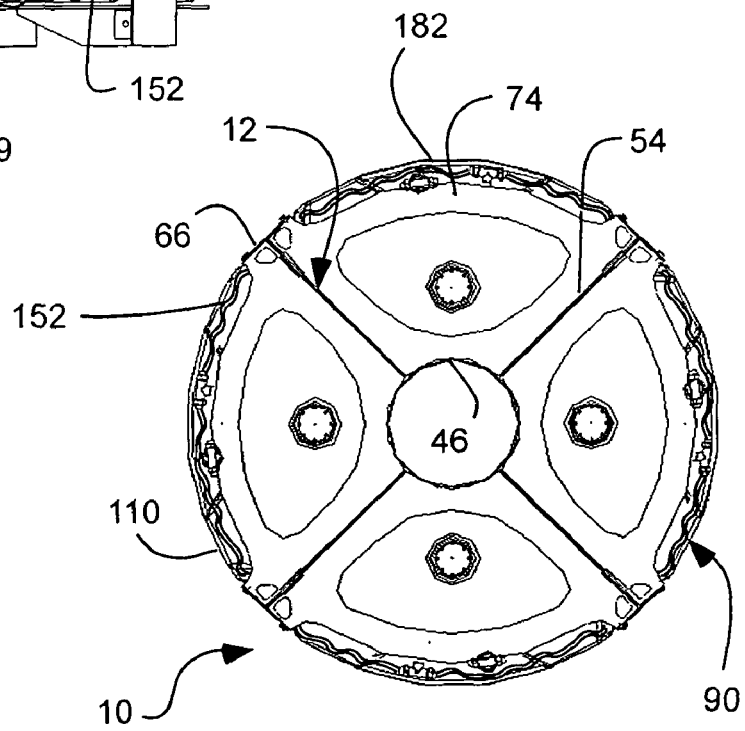
FIG. 10 is a bottom end view of the buoyancy system of FIG. 9.
Figure 11:
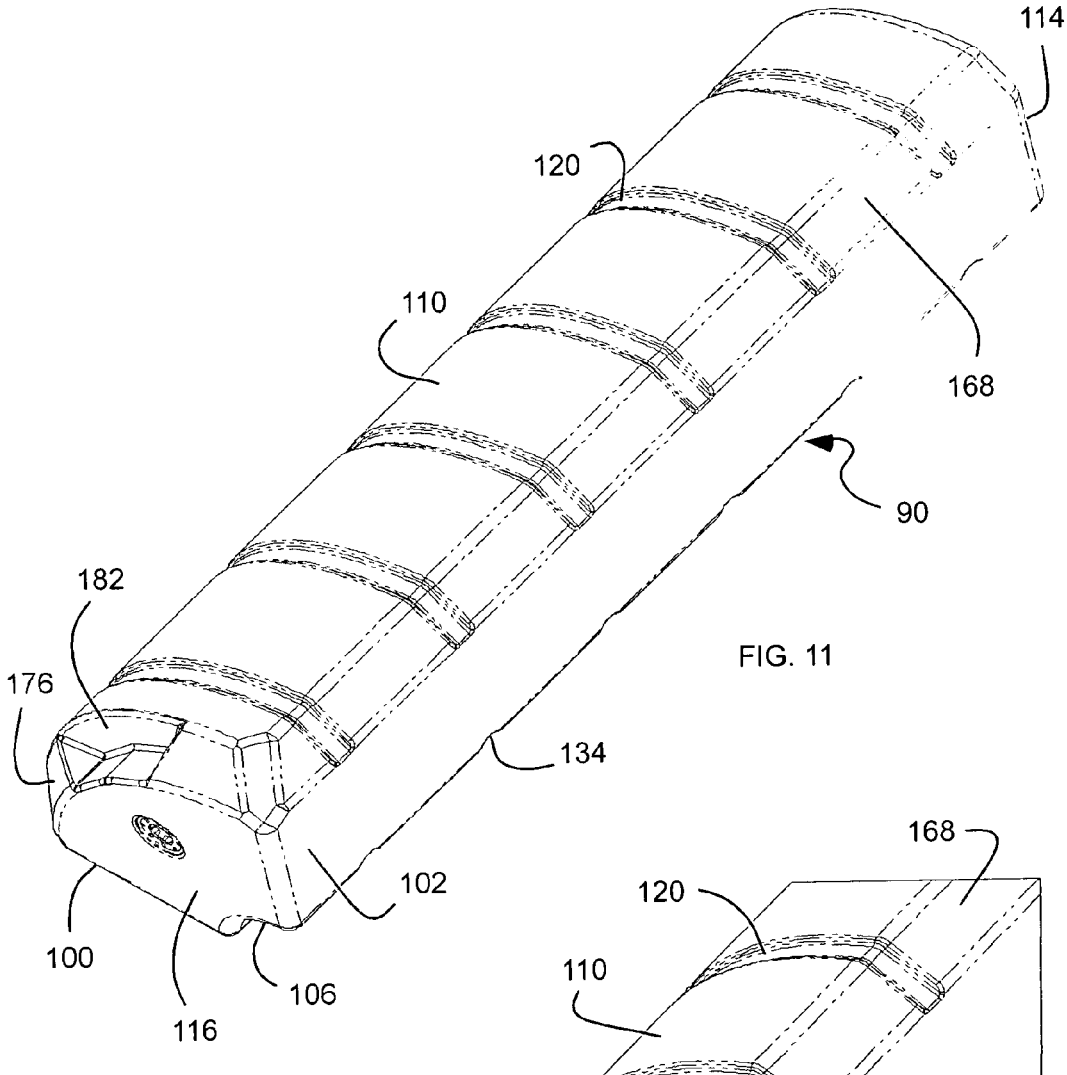
FIG. 11 is a bottom perspective view of a buoyancy compartment of the buoyancy system in accordance with an embodiment of the present invention.
Figure 12:
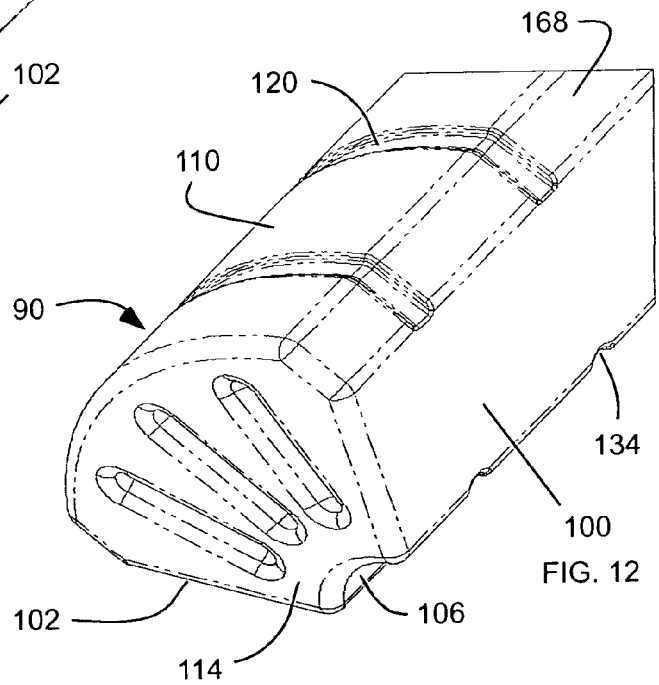
FIG. 12 is partial top perspective view of the buoyancy compartment of FIG. 11.
Figure 15:
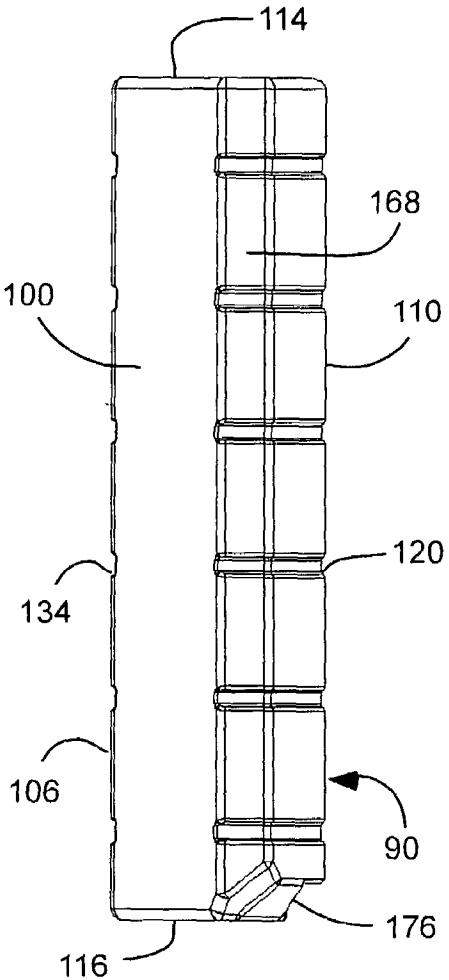
FIG. 15 is a side view of the buoyancy compartment of FIG. 11.
Figure 14:
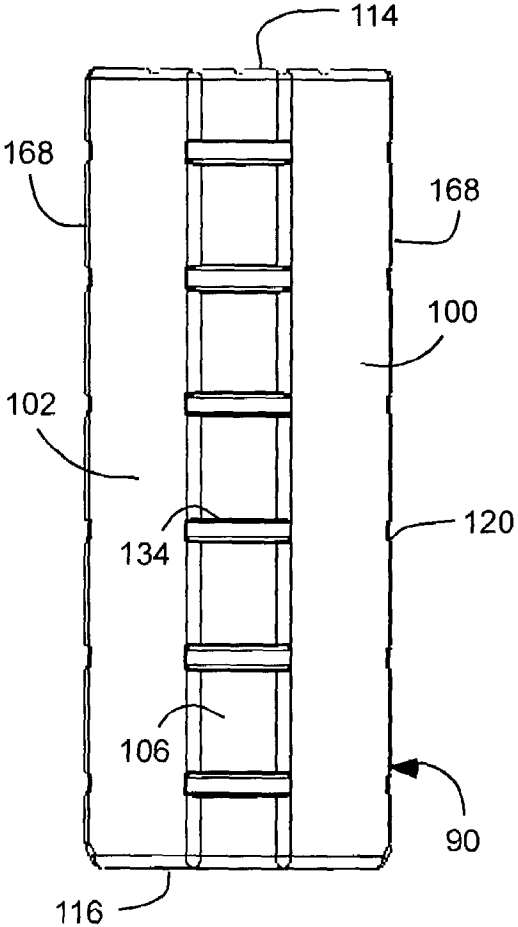
FIG. 14 is an inner side view of the buoyancy compartment of FIG. 11.
Figure 13:
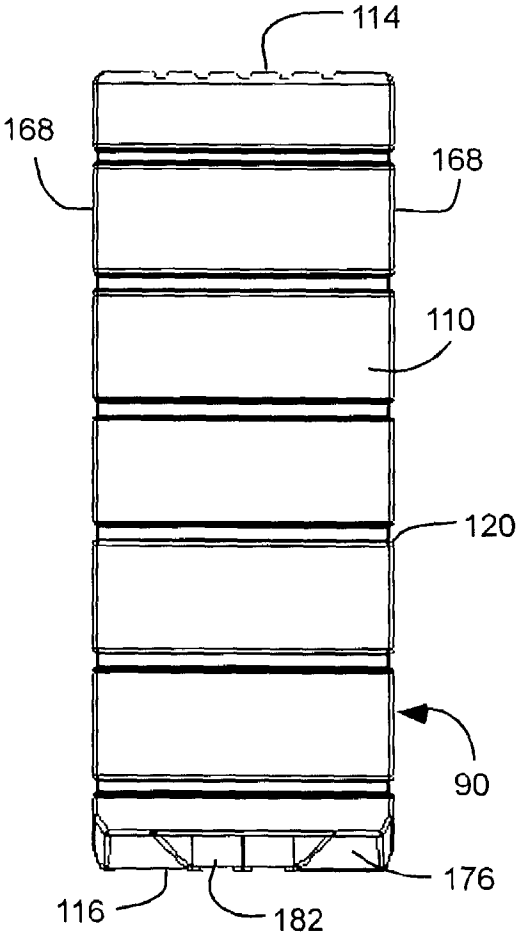
FIG. 13 is an outer side view of the buoyancy compartment of FIG. 11.

As described above, the compartments 90 can circumscribe the stem 46 between the webs 54 to define adjacent lateral compartments. In one aspect, the buoyancy of the adjacent lateral compartments is the same so that there are equal buoyancy forces around the stem. The adjacent lateral compartments can be operatively interconnected, such as by air lines 152 (FIGS. 9 and 10).

The platform 8 can include an air management apparatus to provide and control air to the compartments 90, and thus to control the buoyancy. The air management apparatus can include a pressurized air source and air lines extending from the air source to the compartments. The air source can be a compressor positioned at the platform. The air management apparatus or air source can be used to increase the air in the compartments. For example, air can be introduced into the compartments to drive water out, increasing buoyancy. Alternately, air can be allowed to escape from the compartments, allowing water in, and decreasing buoyancy.

Figure 17:
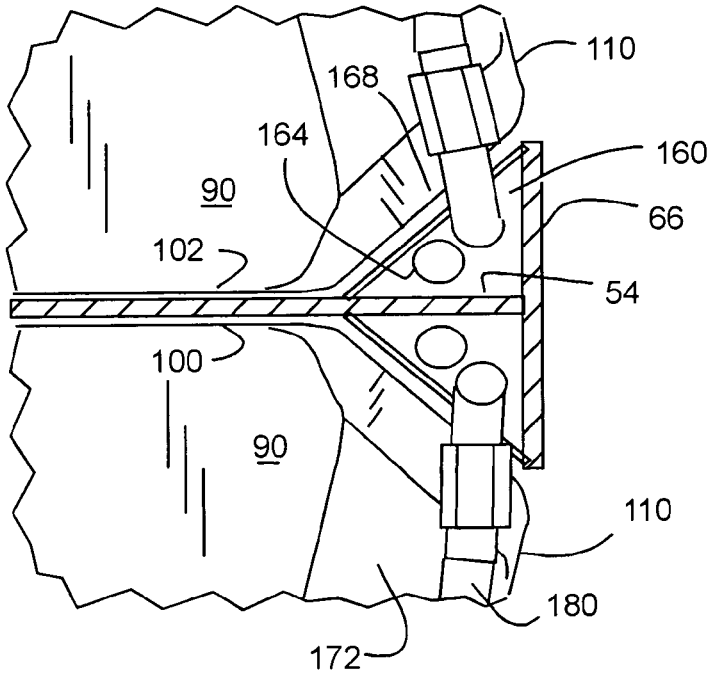
FIG. 17 is a detail view of a channel for air lines to the buoyancy compartment of the buoyancy system in accordance with an embodiment of the present invention.
Figure 18:
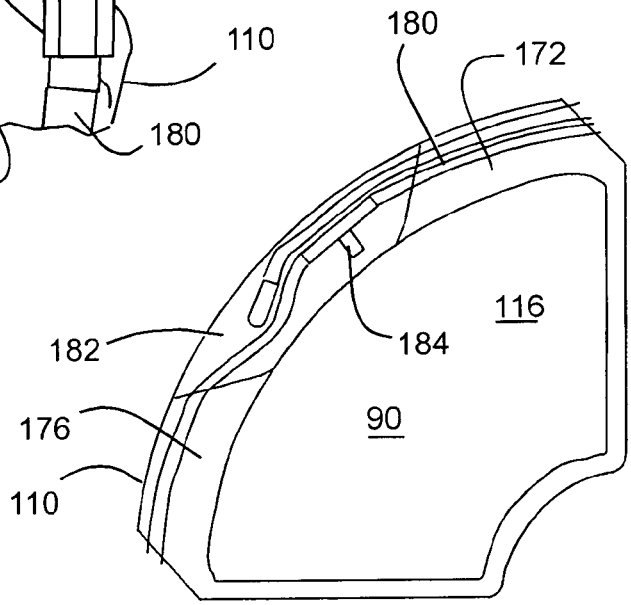
FIG. 18 is a detail view of a channel for air lines to the buoyancy compartment of the buoyancy system in accordance with an embodiment of the present invention.

Referring to FIGS. 17 and 18, the buoyancy system 10 can include channels to accommodate the air lines extending longitudinally along, and laterally around, the buoyancy system to deliver air. For example, a channel 160 can extend longitudinally along the buoyancy system. The channel 160 can be formed between the compartment 90, an adjacent web 54, and an adjacent flange 66. The air line 164 can extend longitudinally through the channel 160. The compartment 90 can include an edge wall 168 between the side wall 100 or 102 and the outer wall 110. The edge wall 168 can form an oblique angle with respect to the web 54. Thus, the channel 160 can be formed between the edge wall 168, the web 54 and the flange 66.

In addition, a channel or indentation 172 can extend laterally or circumferentially around the buoyancy system. The channel 172 can be formed between the bottom wall 116, the outer wall 110. Similarly, an edge wall 176 can be formed between the bottom wall 116 and the outer wall 110. The edge wall 176 can form an oblique angle with respect to the flange 66 or bulkhead 74. Thus, the channel or indentation 172 can be formed between the edge wall 176 and a perimeter of the buoyancy system. The air line 180 can extend laterally or circumferentially through the channel or indentation 172. Furthermore, a pocket 182 can be formed in the bottom of the compartments 90 to facilitate fittings 184 for the air system. The pockets 182 allow the fittings 184 to be maintained within a perimeter of the buoyancy system.

Figure 19A:
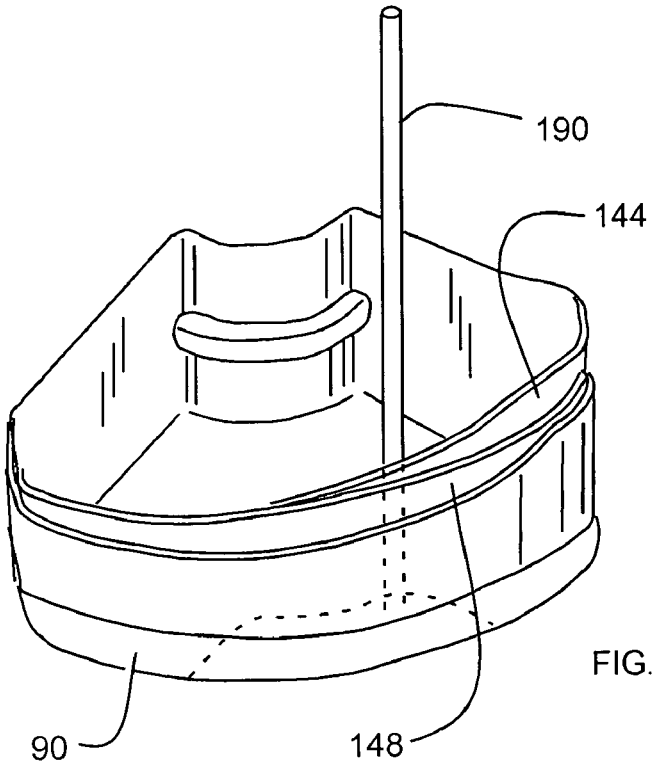
FIG. 19*a* is a partial perspective view of the buoyancy compartment of FIG. 11.
Figure 19B:
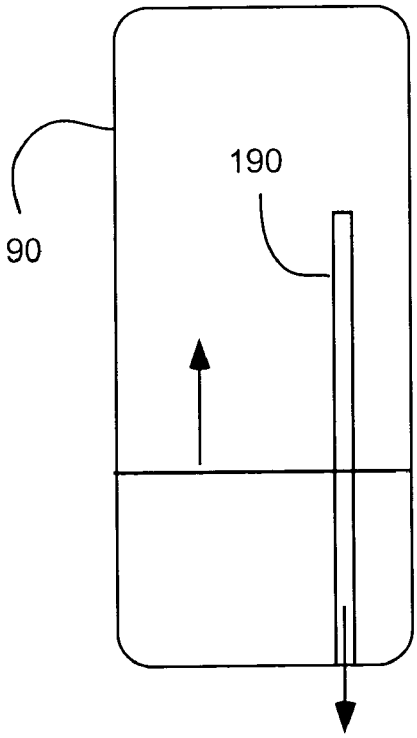
FIGS. 19*b* and 19*c* are schematic views of the buoyancy compartment of FIG. 11.
Figure 19C:
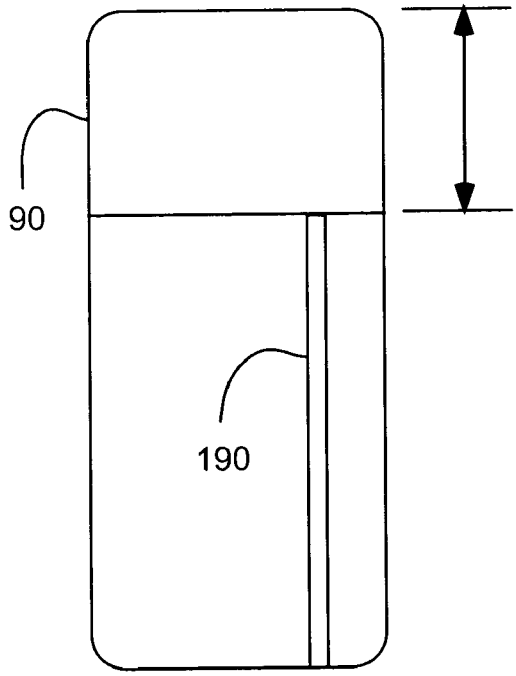

As described above, the air management system can fill the compartments with air, or pressurize the compartments. Alternatively, the air can be released from the compartments to decrease the buoyancy. Thus, water can be allowed into the compartments to displace the air. It can be desirable to maintain a minimum amount or volume of air in the compartments. Thus, referring to FIGS. 19*a*–*c*, an air outlet pipe 190 can be disposed in each of the compartments 90, and can extend from a bottom of the compartments to an intermediate point along a length of the compartments. A minimum space can remain between an upper end of the outlet pipe 190 and a top of the compartment in which the minimum amount of air is disposed. It will be appreciated that as water displaces the air in the compartment (FIG. 19*b*), the water level rises in the compartment until it reaches the upper end of the outlet pipe (FIG. 19*c*), at which point no more air can be removed through the outlet pipe. Thus, a minimum amount of air remains in the compartment, providing a minimum amount of buoyancy.

As described above, the buoyancy system 10, or each section 82, can include four discrete buoyancy compartments 90 circumscribing the stem 46 and disposed in the spaces between the webs 54. Thus, the buoyancy system 10 can have a built-in redundancy for a given length, or for a given buoyancy module. It will be appreciated that the redundancy of four buoyancy compartments, rather than one, reduces the risk of catastrophic failure if there is a leak or loss of air tightness in one of the buoyancy compartments. For example, traditional redundancy in such systems is 10%. Thus, if a 200 ft long section would provide the desired buoyancy in a traditional system, the system would be designed to be 220 ft long and broken into 11 chambers, each 20 ft long. Thus, if one section failed, the system would continue to perform satisfactory. The present system, however, would have forty-four sections, each 20 ft long, so that the present system could suffer four failures and still perform adequately.

As described above, the internal beam 12 can be subjected to variable loads and forces along the length. Thus, the internal beam 12 can be configured to withstand the variable loads and forces. In particular, the webs and/or the flanges can be configured for the variable loads and forces, such as having a thickness that varies along the length of the buoyancy system. For example, certain sections can be thicker to withstand larger loads and forces, while other sections can be thinner to withstand lesser loads and forces.

Figure 21:
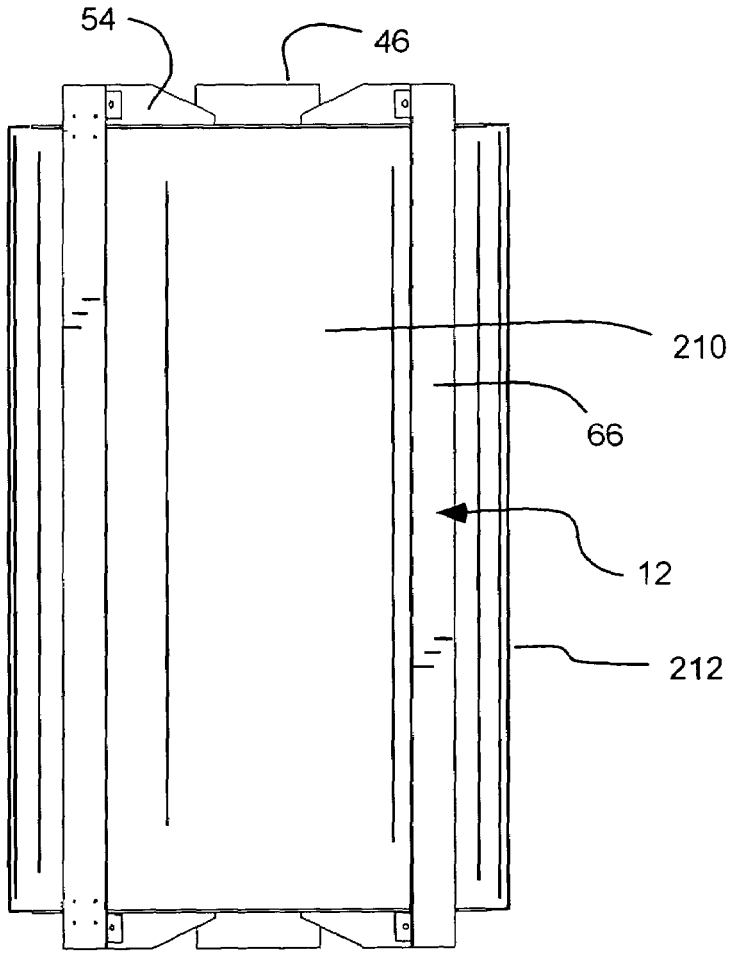
FIG. 21 is a side view of another buoyancy system with an internal beam in accordance with the present invention.

Referring to FIG. 21, a buoyancy system including an internal beam as described above is shown, and can include another buoyant enclosure or compartment. The buoyant enclosure or compartment can be formed by one or more panels 210 extending around the buoyancy system, or around the internal beam. For example, the panels 210 can extend between the flanges 66, and can form a shell 212 that extends circumferentially around the internal beam, or the stem and webs. For example, steel quarter panels 210 can be welded to the flanges 66 to form a steel skin or shell extending around a perimeter of the buoyancy system. The buoyant force can push upward against the bulkheads which transfer the force to the steam. For example, the bulkheads can be located along the stem at 20–24 feet intervals. The panels or shell can be formed of lighter weight flat plates, such as roughly 20 feet by 9 feet in size, rolled to their radius, and then installed on each quadrant of the internal flame, rotating 90 degrees between sections.

The webs and bulkheads of this system can be solid, so that four discrete buoyancy compartments are formed around the stem. Each compartment can be formed between the bulkheads, webs, and panels 210 or shell 212. Thus, the system can take advantage of redundancy as described above.

As described above, two or more modular sections can be combined or joined to form the internal beam. One modular section can be joined to an adjacent modular section by a connection. As described in greater detail below, the connection can include a locking member disposed between opposing grooves. One groove can be formed in the one modular section, and another groove can be formed in the adjacent modular section.

Figure 22A:
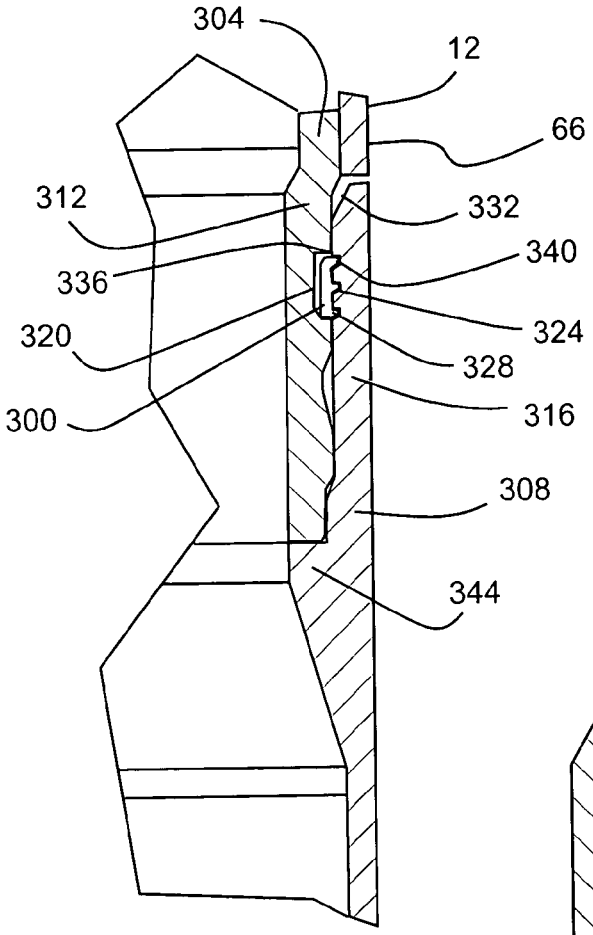
FIG. 22*a* is a partial cross-sectional view of another connection between two modular internal beams of the buoyancy system in accordance with an embodiment of the present invention.
Figure 22B:
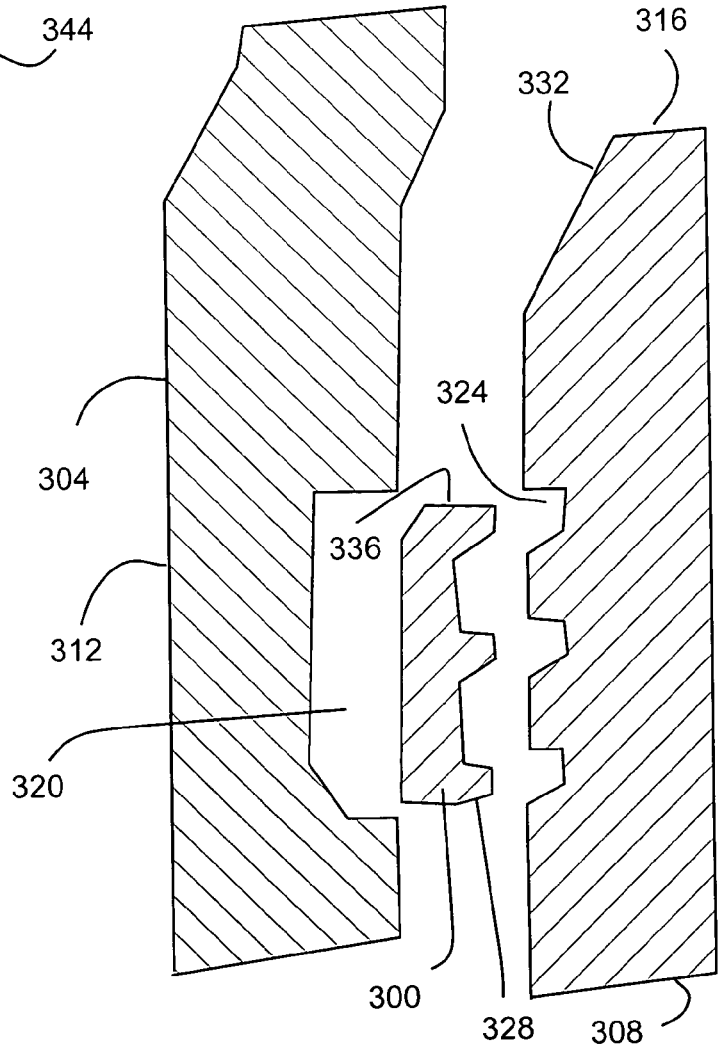
FIG. 22*b* is a partial cross-sectional exploded view of the connection of FIG. 22*a;*

Referring to FIGS. 22*a* and 22*b*, an example of a connection between two modular sections is shown. The connection can include a locking ring 300 disposed between male and female connectors 304 and 308. For example, the male connector 304 can be disposed at a bottom end of the modular section, and can extend into the female connector 308 disposed at a top end of the adjacent modular section. The male and female connectors 304 and 308 can be formed by inner and outer annular flanges 312 and 316 extending around the bottom and top ends of the modular sections. The inner and outer annular flanges 312 and 316 can be attached to the transverse flanges 66 and/or the bulkheads 74 of the internal beam 12.

The inner annular flange 312 can have a smaller diameter than the outer annular flange 316 so that inner annular flange 312 fits within the outer annular flange 316. The locking ring 300 is disposed between annular flanges 312 and 316. Inner and outer annular grooves 320 and 324 can be formed in the inner and outer annular flanges 312 and 316, and can face or open towards one another when the male and female connectors 304 and 308 are connected. (The inner groove 320 can be formed in the inner annular flange 312 and can face or open outwardly, while the outer groove 324 can be formed in the outer annular flange 316 and can face or open inwardly.) The locking ring 300 can be disposed in the annular grooves 320 and 324 to maintain the inner annular flange 312 locked within the outer annular flange 316.

One of the grooves can be sized to receive the locking ring substantially therein. For example, the inner groove 320 can be sized, or can have a depth, to receive the locking ring 300 substantially therein. In addition, the locking ring 300 can be compressible or bendable so that it can be pressed or compressed into the inner groove 320. Furthermore, the locking ring 300 can be resilient, and can expand or protrude from the inner groove 320 and into the outer groove 324. Thus, the locking ring 300 can be compressed into the inner groove 320 as the inner annular flange 312 is inserted into the outer annular flange 316, and can protrude into the outer groove 324 when the inner and outer grooves 320 and 324 are aligned.

The locking ring 300 can have a tapered or angled leading edge 328. Similarly, the outer annular flange 316 can have a tapered or angled leading edge 332. The angled leading edges 328 and 332 can abut to one another during insertion of the inner annular flange to facilitate compression of the locking ring. In addition, the locking ring 300 can have an abrupt trailing edge 336, while the outer groove 324 can have an abrupt edge 340 to abut to the trailing edge 336 of the locking ring 300.

In addition, the female connector 308 can have a ledge 344 against which the male connector 304 or inner annular flange 312 abuts. Thus, axial or longitudinal loads can be transferred primarily through the connectors, while the locking ring 300 primarily maintains the connection between the modular sections.

Figure 23:
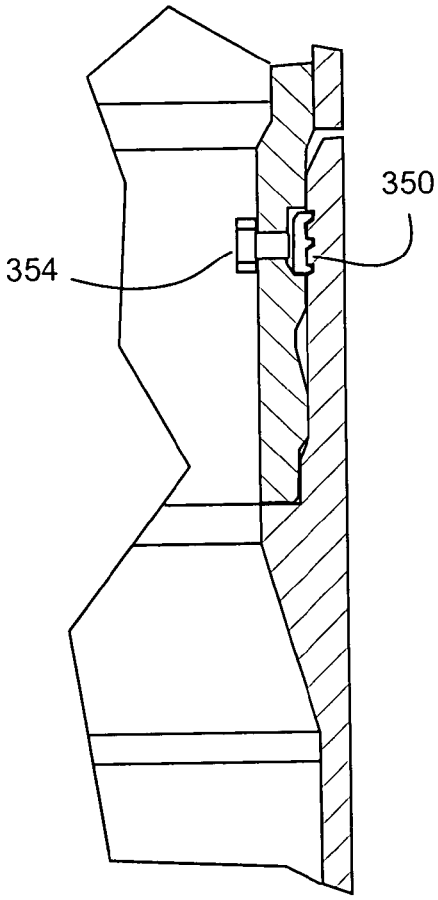
FIG. 23 is a partial cross-sectional view of another connection between two modular internal beams of the buoyancy system in accordance with an embodiment of the present invention.

Referring to FIG. 23, another connection is shown that is similar in many respects to that described above. The connection can include a locking ring 350 disposed between male and female connectors. The locking ring 350 can be held in place by bolts 354.

Figure 24:
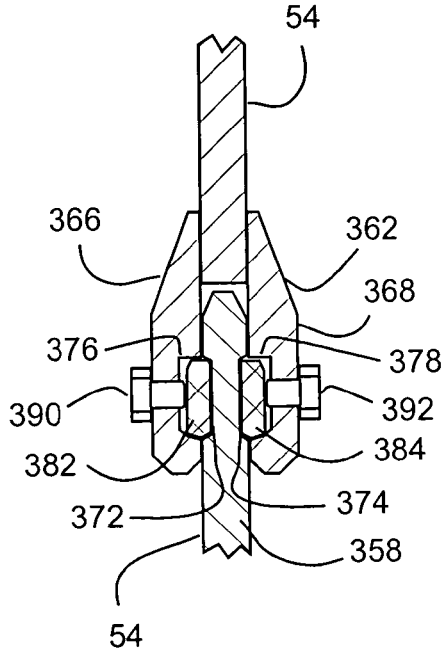
FIG. 24 is a partial cross-sectional view in accordance with another connection between two modular internal beams of the buoyancy system in accordance with an embodiment of the present invention.

Referring to FIG. 24, a connection can be formed between the webs 54. The connection can include male and female connectors 358 and 362. For example, the male connector 358 can be disposed at a top end of the modular section, and can extend into the female connector 362 disposed at a bottom end of the adjacent modular section. The male connector 358 can be formed by or on the webs 54, and can extend along the webs between the stem pipe and the transverse flange. The female connector 362 can be formed by a pair of flanges 366 and 368 attached to opposite sides of the webs 54 and forming a cavity therebetween. The male connector 358 can extend between the flanges 366 and 368. One or more grooves can be formed in the male connector 358, such as a pair of grooves 373 and 374 each formed on opposite sides of the male connector 358; and can correspond to one or more grooves formed in the female connector 362, such as a pair of grooves 376 and 378 formed on opposite sides of the female connector 362. One or more locking bars can be disposed in the grooves to lock the male connector 358 in the female connector 362. A first locking bar 382 can be disposed in a first pair of grooves 372 and 376; while a second locking bar 384 can be disposed in a second pair of grooves 374 and 378. The locking bars 382 and 384 can be disposed within the grooves 376 and 378 while the male connector 358 is inserted into the female connector 362. After the male connector 358 is inserted into the female connector 362, the locking bars 382 and 384 can move into the grooves 372 and 374 of the male connector 358. The locking bars 382 and 384 can be displaced and held in place by bolts 390 and 392. The grooves and locking bars can extend substantially along the length of the webs, between the stem pipe and the transverse flanges.

From the above description it will be appreciated that the present invention provides a simple, minimum weight, load bearing structure, i.e. the internal beam 12, and packages the required buoyancy around it. In addition, the buoyant forces are transferred to the stem.

It is to be understood that the above-referenced arrangements are only illustrative of the application for the principles of the present invention. Numerous modifications and alternative arrangements can be devised without departing from the spirit and scope of the present invention while the present invention has been shown in the drawings and fully described above with particularity and detail in connection with what is presently deemed to be the most practical and preferred embodiments(s) of the invention, it will be apparent to those of ordinary skill in the art that numerous modifications can be made without departing from the principles and concepts of the invention as set forth in the claims.

What is claimed is:

1. An internal beam device configured for a buoyancy system for an offshore oil platform, the device comprising:

a) an elongated, vertical stem extending substantially along the buoyancy system and having an axially disposed bore configured to receive at least one riser therethrough;

b) a plurality of webs, extending substantially along a length of the elongated stem, having inner edges attached to the stem and extending radially outwardly therefrom to opposite outer edges; and c) a plurality of transverse flanges, attached to the outer edges of the webs, the stem, the webs, and the transverse flanges forming a structural beam configured to withstand loads between the buoyancy system and the oil platform;

wherein the stem, the webs and the transverse flanges include a plurality of modular sections joined end-to-end in series.

2. A device in accordance with claim 1, wherein the plurality of webs includes at least four webs oriented in at least two different orientations.

3. A device in accordance with claim 1, wherein the plurality of webs further includes:

a) a first pair of webs disposed on opposite sides of the stem, and b) a second pair of webs disposed on opposite sides of the stem and oriented perpendicularly to the first pair of webs.

4. A device in accordance with claim 1, wherein the webs include an array of apertures formed therein along a length of the webs.

5. A device in accordance with claim 1, further comprising:

a plurality of bulkheads, disposed around the stem and oriented transverse to both the stem and the plurality of webs, and extending between adjacent webs.

6. A device in accordance with claim 1, wherein each of the modular sections includes a plurality of fins extending therefrom towards the plurality of fins of an adjacent modular section;

and further comprising a plurality of splice plates, each secured to a pair of adjacent fins, to secure the adjacent fins, and thus the adjacent modular sections, together.

7. A device in accordance with claim 1, wherein one modular section is joined to an adjacent modular section by a connection including opposing grooves with one groove formed in the one modular section and another groove formed in the adjacent modular section, the connection further including a locking member disposed in the opposing grooves.

8. A device in accordance with claim 1, further comprising buoyancy means, couplable to the stem, for containing a buoyant material and securing the buoyant material to the stem.

9. An internal beam device configured for a buoyancy system for an offshore oil platform, the device comprising:

an elongated, vertical stem extending substantially along the buoyancy system and having an axially disposed bore configured to receive at least one riser therethrough;

a plurality of webs, extending substantially along a length of the elongated stem, having inner edges attached to the stem and extending radially outwardly therefrom to opposite outer edges;

a plurality of transverse flanges, attached to the outer edges of the webs; and a plurality of compartments configured to be coupled to the stem and to be disposed between the webs, the compartments containing a buoyant material;

wherein the stem, the webs, and the transverse flanges form a structural beam configured to withstand loads between the buoyancy system and the oil platform; wherein the compartments circumscribe the stem defining adjacent lateral compartments; and wherein the adjacent lateral compartments are operatively interconnected by air lines.

10. A device in accordance with claim 9, further comprising:

a) an air management apparatus including at least one air line configured to be coupled to a pressurized air source, and couplable to the compartments; and b) a channel, formed between at least one of the compartments, an adjacent web, and an adjacent flange, the air line extending through the channel.

11. A device in accordance with claim 9, further comprising:

a) a plurality of ribs formed along the stem; and b) a plurality of mating grooves formed in the compartments, the ribs and the grooves intermeshing such that a buoyancy force of the compartment is transferred to the stem through the ribs.

12. A device in accordance with claim 11, further comprising:

a) a gap, formed between a rib and a groove; and b) a shim, disposed the gap.

13. A device in accordance with claim 9, further comprising:

a) a plurality of arcuate indentations formed in an outer wall of the enclosures; and b) a plurality of retention straps, attached to the structural beam and engaging the enclosures at the indentations.

14. A device in accordance with claim 9, wherein each of the plurality of compartments has a shape that substantially fills a space between adjacent webs, including opposite side walls disposable adjacent the webs, an inner arcuate wall disposable adjacent the stem, and an outer arcuate wall opposite the inner arcuate wall.

15. A device in accordance with claim 9, wherein each of the plurality of compartments includes a one-piece, continuous liner encapsulated in a fiber composite matrix laminate.

16. A device in accordance with claim 9, wherein each of the plurality of compartments includes a one-piece, continuous liner formed of a thermoplastic material.

17. A device in accordance with claim 9, wherein each of the plurality of compartments includes pigment to color the material to facilitate inspection.

18. A buoyancy system configured for an offshore oil platform, the system comprising:

a) an elongated, vertical stem extending substantially along the buoyancy system and having an axially disposed bore configured to receive at least one riser therethrough;

b) a plurality of webs, extending substantially along a length of the elongated stem, having inner edges attached to the stem and extending radially outwardly therefrom to opposite outer edges;

c) a plurality of transverse flanges, attached to the outer edges of the webs, the stem, the webs, and the transverse flanges forming a structural beam configured to withstand loads between the buoyancy system and the oil platform; and d) at least one enclosure, coupled to the stem, and containing a buoyant material configured to produce a buoyancy force;

wherein the stem, the webs, and the flanges include a plurality of modular sections joined end-to-end in series.

19. A system in accordance with claim 18, wherein:

a) the plurality of webs includes at least four webs oriented in at least two different orientations, the four webs forming four sections disposed circumferentially around the stem and extending axially along the stem; and b) the enclosure includes at least four separate enclosures disposed in the four sections.

20. A system in accordance with claim 18, wherein the plurality of webs farther includes:

a) a first pair of webs disposed on opposite sides of the stem, and b) a second pair of webs disposed on opposite sides of the stem and oriented perpendicularly to the first pair of webs to form four sections disposed circumferentially around the stem.

21. A system in accordance wit claim 18, wherein each of the modular sections includes a plurality of fins extending therefrom towards the plurality of fins of an adjacent modular section; and further comprising a plurality of splice plates, each secured to a pair of adjacent fins, to secure the adjacent fins, and thus the adjacent modular sections, together.

22. A system in accordance with claim 18, wherein one modular section is joined to an adjacent modular section by a connection including opposing grooves with one groove formed in the one modular section and another groove formed in the adjacent modular section, the connection further including a locking member disposed in the opposing grooves.

23. A buoyancy system configured for an offshore oil platform, the system comprising:

an elongated, vertical stem extending substantially along the buoyancy system and having an axially disposed bore configured to receive at least one riser therethrough;

a plurality of webs, extending substantially along a length of the elongated stem, having inner edges attached to the stem and extending radially outwardly therefrom to opposite outer edges;

a plurality of transverse flanges, attached to the outer edges of the webs, wherein the stem, the webs, and the transverse flanges form a structural beam configured to withstand loads between the buoyancy system and the oil platform; and at least one enclosure, coupled to the stem, and containing a buoyant material configured to produce a buoyancy force, wherein the at least one enclosure includes a plurality of compartments disposed between the webs and configured to be coupled to the stem.

24. A system in accordance with claim 23, wherein the plurality of compartments circumscribe the stem defining adjacent lateral compartments; and wherein the adjacent lateral compartments are operatively interconnected by air lines.

25. A system in accordance wit claim 23, further comprising:

a) an air management apparatus including at least one air line configured to be coupled to a pressurized air source, and couplable to the compartments; and b) a channel, formed between at least one of the compartments, an adjacent web, and an adjacent flange, the air line extending through the channel.

26. A system in accordance with claim 23, further comprising:

a) a plurality of ribs formed along the stem: and b) a plurality of mating grooves formed in the compartments, the ribs and the grooves intermeshing such that a buoyancy force of the compartment is transferred to the stem through the ribs.

27. A system in accordance with claim 26, further comprising:

a) a gap, formed between a rib and a groove; and b) a liquid shim, disposed the gap.

28. A system in accordance with claim 23, further comprising:

a) a plurality of arcuate indentations formed in an outer wall of the enclosures; and b) a plurality of retention straps, attached to the structural beam and engaging the enclosures at the indentations.

29. A system in accordance with claim 23, wherein each of the plurality of compartments has a shape that substantially fills a space between adjacent webs, including opposite side walls disposable adjacent the webs, an inner arcuate wail disposable adjacent the stem, and an outer arcuate wall opposite the inner arcuate wall.

30. A system in accordance with claim 23, wherein each of the plurality of compartments includes a one-piece, continuous liner encapsulated in a fiber composite matrix laminate.

31. A system in accordance with claim 23, wherein each of the plurality of compartments includes a one-piece, continuous liner formed of a thermoplastic material.

32. An offshore oil platform system, comprising:

a) an oil platform configured to float partially or wholly submerged;

b) at least one riser, operatively couplable to the oil platform and configured to extend from the oil platform to a seabed and to conduct oil or gas therethrough; and c) a buoyancy system, movably disposable in the oil platform and configured to apply a buoyancy force to the at least one riser to support the riser, the buoyancy system including:

1) an elongated internal beam, configured to withstand loads between the oil platform and the buoyancy system, extending substantially along the buoyancy system, having a) an elongated stem with an axially disposed bare configured to receive at least one riser therethrough, b) a plurality of webs, extending substantially along a length of the elongated stem, having inner edges attached to the stem and extending radially outwardly therefrom to opposite outer edges, and c) a plurality of transverse flanges, attached to the outer edges of the webs; and 2) at least one enclosure, coupled to the stem, and containing a buoyant material configured to produce a buoyancy force when submerged, wherein the enclosure includes a plurality of compartments disposed between the webs and configured to be coupled to the stem.

33. A system in accordance with claim 32, wherein the oil platform further includes a partially or wholly submerged hull having a framework with at least one vertically oriented shaft formed therein in which the buoyancy system is movably disposed; and wherein the internal beam has a width that substantially spans a width of the shaft.

34. A system in accordance with claim 32, wherein:

a) the plurality of webs includes at least four webs oriented in at least four different orientations, the four webs forming four sections disposed circumferentially around the stem and extending axially along the stem; and b) the enclosure includes at least four separate enclosures disposed in the four sections.

35. A system in accordance with claim 32, wherein the plurality of webs further includes:

a) a first pair of webs disposed on opposite sides of the stem, and b) a second pair of webs disposed on opposite sides of the stein and oriented perpendicularly to the first pair of webs to form four sections disposed circumferentially around the stem.

36. A system in accordance with claim 32, further comprising:

a plurality of bulkheads, disposed around the stem and oriented transverse to both the stem and the plurality of webs, and extending between adjacent webs.

37. A system in accordance with claim 32, wherein the stem, the webs and the transverse flanges include a plurality of modular sections joined end-to-end in series.

38. A system in accordance with claim 37, wherein each of the modular sections includes a plurality of fins extending therefrom towards the plurality of fins of an adjacent modular section; and farther comprising a plurality of splice plates, each secured to a pair of adjacent fins, to secure the adjacent fins, and thus the adjacent modular sections, together.

39. A system in accordance with claim 37, wherein one modular section is joined to an adjacent modular section by a connection including opposing grooves with one groove formed in the one modular section and another groove formed in the adjacent modular section, the connection further including a locking member disposed in the opposing grooves.

40. A system in accordance with claim 32, further comprising:

a) an air management apparatus including at least one air line configured to be coupled to a pressurized air source, and couplable to the compartments; and b) a channel, formed between at least one of the compartments, an adjacent web, and an adjacent flange, the air line extending through the channel.

41. A system in accordance with claim 32, further comprising:

a) a plurality of ribs formed along the stem; and b) a plurality of mating grooves formed in the compartments, the ribs and the grooves intermeshing such that a buoyancy force of the compartment is transferred to the stem through the ribs.

42. A system in accordance with claim 32, further comprising:

a) a plurality of arcuate indentations formed in an outer wall of the enclosures; and b) a plurality of retention straps, attached to the structural beam and engaging the enclosures at the indentations.

43. A system in accordance with claim 32, wherein each of the plurality of compartments has a shape that substantially fills a space between adjacent webs, including opposite side walls disposable adjacent the webs, an inner arcuate wall disposable adjacent the stem, and an outer arcuate wall opposite the inner arcuate wall.

44. A system in accordance with claim 32, wherein each of the plurality of compartments includes a one-piece, continuous liner encapsulated in a fiber composite matrix laminate.

45. A system in accordance with claim 32, wherein each of the plurality of compartments includes a one-piece, continuous liner formed of a thermoplastic material.

46. A frame for a buoyancy system used to support the weight of a riser on an offshore oil platform, comprising:

a plurality of sections connected end-to-end for the length of the buoyancy system, each section comprising:

a stem extending axially through the section and having a bore for receiving at least one riser;

at least four webs extending radially from the stem and extending substantially the entire length of the section, the stem and the webs being adapted to withstand forces applied to the buoyancy system during use; and a bulkhead disposed at each end of each section and connected to ends of the at least four webs, the bulkheads of adjacent sections including means for securing the two sections together to provide a framework for a buoyancy system having a continuous frame for withstanding the loads applied to the buoyancy system during use.

47. An internal beam device configured for a buoyancy system for an offshore oil platform, the device comprising:

an elongated, vertical stem extending substantially along the buoyancy system and having an axially disposed bore configured to receive at least one riser therethrough;

a plurality of webs, extending substantially along a length of the elongated stem, having inner edges attached to the stem and extending radially outwardly therefrom to opposite outer edges;

a plurality of transverse flanges, attached to the outer edges of the webs; and a plurality of compartments configured to be coupled to the stem and to be disposed between the webs, the compartments containing a buoyant material; wherein the stem, the webs, and the transverse flanges form a structural beam configured to withstand loads between the buoyancy system and the oil platform; and wherein at least one of the compartments includes 1) a side wall disposable adjacent the web, 2) an outer wall, and 3) and an edge wall between the side wall and the outer wall, the edge wall forming an oblique angle with respect to the web, a longitudinal channel being formed between the web, the flange, and the edge wall; and further comprising an air line extending through the longitudinal channel.

48. An internal beam device configured for a buoyancy system for an offshore oil platform, the device comprising:

an elongated, vertical stem extending substantially along the buoyancy system and having an axially disposed bore configured to receive at least one riser therethrough;

a plurality of webs, extending substantially along a length of the elongated stem, having inner edges attached to the stem and extending radially outwardly therefrom to opposite outer edges;

a plurality of transverse flanges, attached to the outer edges of the webs; and a plurality of compartments configured to be coupled to the stem and to be disposed between the webs, the compartments containing a buoyant material;

wherein the stem, the webs, and the transverse flanges form a structural beam configured to withstand loads between the buoyancy system and the oil platform; and wherein at least one of the buoyancy modules includes 1) a bottom wall extending between adjacent webs, 2) an outer wall, and 3) and an edge wall between the bottom wall and the outer wall, the edge wall forming an oblique angle with respect to the flange, a circumferential indentation being formed between the bottom wall and the edge wall; and further comprising an air line extending in the circumferential indentation.

49. An internal beam device configured for a buoyancy system for an offshore oil platform, the device comprising:

an elongated, vertical stem extending substantially along the buoyancy system and having an axially disposed bore configured to receive at least one riser therethrough;

a plurality of webs, extending substantially along a length of the elongated stem, having inner edges attached to the stem and extending radially outwardly therefrom to opposite outer edges;

a plurality of transverse flanges, attached to the outer edges of the webs; and a plurality of compartments configured to be coupled to the stem and to be disposed between the webs, the compartments containing a buoyant material;

wherein the stem, the webs, and the transverse flanges form a structural beam configured to withstand loads between the buoyancy system and the oil platform; wherein the compartments are configured to be pressurized with air; wherein the compartments include side walls disposable adjacent the webs; and wherein the side walls are flexible and bear against the webs to apply lateral loads to the webs when the compartments are pressurized.

50. An internal beam device configured for a buoyancy system for an offshore oil platform, the device comprising:

an elongated, vertical stem extending substantially along the buoyancy system and having an axially disposed bore configured to receive at least one riser therethrough;

a plurality of webs, extending substantially along a length of the elongated stem, having inner edges attached to the stem and extending radially outwardly therefrom to opposite outer edges;

a plurality of transverse flanges, attached to the outer edges of the webs;

a plurality of compartments configured to be coupled to the stem and to be disposed between the webs, the compartments containing a buoyant material; and an air outlet pipe, disposed in each of the compartments, and extending from a bottom of the compartment to an intermediate point along a length of the compartment;

wherein the stem, the webs, and the transverse flanges form a structural beam configured to withstand loads between the buoyancy system and the oil platform.

51. An internal beam device configured for a buoyancy system for an offshore oil platform, the device comprising:

an elongated, vertical stem extending substantially along the buoyancy system and having an axially disposed bore configured to receive at least one riser therethrough;

a plurality of webs, extending substantially along a length of the elongated stem, having inner edges attached to the stem and extending radially outwardly therefrom to opposite outer edges; and a plurality of transverse flanges, attached to the outer edges of the webs;

wherein the stem, the webs, and the transverse flanges form a structural beam configured to withstand loads between the buoyancy system and the oil platform;

and wherein the webs or the flanges have a thickness that varies along the length of the buoyancy system.

52. A buoyancy system configured for an offshore oil platform, the system comprising:

an elongated, vertical stem extending substantially along the buoyancy system and having an axially disposed bore configured to receive at least one riser therethrough;

a plurality of webs, extending substantially along a length of the elongated stem, having inner edges attached to the stem and extending radially outwardly therefrom to opposite outer edges;

a plurality of transverse flanges, attached to the outer edges of the webs, the stem, the webs, and the transverse flanges forming a structural beam configured to withstand loads between the buoyancy system and the oil platform;

at least one enclosure, coupled to the stem, and containing a buoyant material configured to produce a buoyancy force; and a plurality of bulkheads, disposed around the stem and oriented transverse to both the stem and the plurality of webs, and extending between adjacent webs.

53. A buoyancy system configured for an offshore oil platform, the system comprising:

an elongated, vertical stem extending substantially along the buoyancy system and having an axially disposed bore configured to receive at least one riser therethrough;

a plurality of webs, extending substantially along a length of the elongated stem, having inner edges attached to the stem and extending radially outwardly therefrom to opposite outer edges;

a plurality of transverse flanges, attached to the outer edges of the webs, the stem, the webs, and the transverse flanges forming a structural beam configured to withstand loads between the buoyancy system and the oil platform; and at least one enclosure, coupled to the stem, and containing a buoyant material configured to produce a buoyancy force; wherein the webs or the flanges have a thickness that varies along the length of the buoyancy system.

* * * * *